US008852834B2

(12) United States Patent
Santo et al.

(10) Patent No.: US 8,852,834 B2
(45) Date of Patent: Oct. 7, 2014

(54) TONER FOR ELECTROPHOTOGRAPHY, DEVELOPER, IMAGE FORMING METHOD, AND PROCESS CARTRIDGE

(71) Applicants: Hideyuki Santo, Shizuoka (JP); Shinya Nakayama, Shizuoka (JP); Atsushi Yamamoto, Shizuoka (JP); Daiki Yamashita, Kanagawa (JP); Suzuka Amemori, Shizuoka (JP)

(72) Inventors: Hideyuki Santo, Shizuoka (JP); Shinya Nakayama, Shizuoka (JP); Atsushi Yamamoto, Shizuoka (JP); Daiki Yamashita, Kanagawa (JP); Suzuka Amemori, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/680,274

(22) Filed: Nov. 19, 2012

(65) Prior Publication Data

US 2013/0143155 A1 Jun. 6, 2013

(30) Foreign Application Priority Data

Dec. 1, 2011 (JP) ..... 2011-263686
Oct. 4, 2012 (JP) ..... 2012-222561

(51) Int. Cl.

| | |
|---|---|
| ***G03G 9/08*** | (2006.01) |
| ***G03G 9/087*** | (2006.01) |
| ***G03G 9/09*** | (2006.01) |
| *G03G 13/20* | (2006.01) |

(52) U.S. Cl.

CPC ..... *G03G 9/08764* (2013.01); *G03G 9/08797* (2013.01); *G03G 13/20* (2013.01); *G03G 9/0926* (2013.01)

USPC ..... 430/108.1; 430/109.4; 430/109.5; 430/111.4

(58) Field of Classification Search

USPC ..... 430/108.1, 111.4, 109.4, 109.5

See application file for complete search history.

(56) References Cited

U.S. PATENT DOCUMENTS

| | | | | |
|---|---|---|---|---|
| 2001/0046636 | A1 | 11/2001 | Daimon et al. | |
| 2009/0068582 | A1* | 3/2009 | Kawaguchi | 430/109.4 |
| 2010/0104965 | A1 | 4/2010 | Inoue et al. | |

FOREIGN PATENT DOCUMENTS

| | | | |
|---|---|---|---|
| CN | 101382745 | A | 3/2009 |
| CN | 102314107 | A | 1/2012 |
| JP | 62-028075 | | 2/1987 |
| JP | 63-038955 | | 2/1988 |
| JP | 3910338 | | 2/2007 |
| JP | 2008-070466 | | 3/2008 |
| JP | 2010-077419 | | 4/2010 |
| JP | 2010-122667 | | 6/2010 |
| JP | 4929411 | | 2/2012 |
| WO | WO2012/011546 | A1 | 1/2012 |

OTHER PUBLICATIONS

U.S. Appl. No. 13/458,512, filed Apr. 27, 2012, Shinya Nakayama, et al.

Office Action issued Apr. 1, 2014, in Chinese Patent Application No. 201210510809.X (w/English translation).

* cited by examiner

*Primary Examiner* — Mark A Chapman

(74) *Attorney, Agent, or Firm* — Oblon, Spivak, McClelland, Maier & Neustadt, L.L.P.

(57) ABSTRACT

To provide a toner, including: a crystalline binder resin including a urethane bond or a urea bond, or both thereof; and a colorant, wherein the colorant has a number-average particle diameter of 0.5 μm or less, and a ratio of particles having a particle diameter of 0.7 μm or greater in a number-size distribution of the colorant is 5% by number or less.

11 Claims, 7 Drawing Sheets

TONER FOR ELECTROPHOTOGRAPHY, DEVELOPER, IMAGE FORMING METHOD, AND PROCESS CARTRIDGE

BACKGROUND OF THE INVENTION

1. Field of the Invention

The present invention relates to a toner for electrophotography, a developer using the same, and an image forming method and a process cartridge using this developer.

2. Description of the Related Art

Depletion of petroleum resources and a problem of global warming by carbon dioxide discharged into the atmosphere due to mass consumption of the petroleum resources are concerned. There, when a binder resin used for a toner is replaced by a plant-derived resin, carbon dioxide generated from the binder resin circulates only in the environment, and there is a possibility that the problem of global warming and the depletion of the petroleum resources may be simultaneously solved. Also, another effort for the environmental problems, an energy-saving copying machine is desired. Most of the energy consumed by a copying machine is thermal energy for melting a toner and fixing it on paper. Thus, an energy-saving copying machine with reduced environmental load may be achieved if the toner melts at a low temperature, and a low-temperature fixing toner is desired. As a means for obtaining the low-temperature fixing toner, a glass transition temperature of a binder resin is reduced, in general. However, when the glass transition temperature is excessively reduced, storage stability of the toner degrades. As a means to achieve both storage stability and low-temperature fixing property, it is known to use a crystalline resin as a binder resin. However, a high ratio of the crystalline resin in the binder resin degrades dispersibility of a pigment, and there is a problem that color reproducibility of a fixed image degrades.

In addition, a high degree of crystallinity of the crystalline resin causes a problem that the pigment does not easily penetrate into the binder resin. Because of this, the pigment is located eccentrically in toner particles. The pigment does not spread when an image is formed with the toner and fixed on paper, and as a result, the image has low color reproducibility. As a countermeasure, it is known to use a masterbatch that a pigment is dispersed in a resin in advance. However, when the crystalline resin is used for the masterbatch, the pigment still does not disperse well in the resin. It is possible to disperse the pigment well when a non-crystalline resin is used for the masterbatch, but it is a factor of inhibiting low-temperature fixing property derived from the crystalline resin.

Accordingly, a toner including crystalline resin and having excellent color reproducibility, low-temperature fixing property and storage stability, and a related technology thereof have not yet been obtained, and at present, further improvement and development therefor are desired.

As a technology close to the present invention, in Japanese Patent Application Laid-Open (JP-A) No. 2010-77419, a crystalline resin is used for the purpose of providing a toner having excellent low-temperature fixing property and blocking resistance. However, pigment dispersibility, etc. is not studied, and the problem of color reproducibility is not solved. Also, in JP-A No. 62-28075, a polyester resin (resin A) is used as a binder resin, and a pigment is coated in advance with a polyester resin (resin B) having a higher molecular weight than resin A, and a color toner is obtained by dispersing this coated pigment in resin A. However, there is no disclosure regarding a crystalline resin.

SUMMARY OF THE INVENTION

The present invention aims at providing: a toner for electrophotography which can achieve high color reproducibility, low-temperature fixing property and storage stability even when a crystalline resin is used for a binder resin; a developer using the same; and an image forming method and a process cartridge using this developer.

Means for solving the problems are as follows. That is,

A toner of the present invention includes: a crystalline binder resin having a urethane bond or a urea bond, or both thereof; and colorant, wherein the colorant has a number-average particle diameter of 0.5 μm or less, and a ratio of particles having a particle diameter of 0.7 μm or greater in a number-size distribution is 5% by number or less.

According to the present invention, it is possible to provide: a toner for electrophotography which may achieve color reproducibility, low-temperature fixing property and storage stability even when a crystalline resin is used for a binder resin; a developer using the same, and an image forming method and a process cartridge using this developer.

DETAILED DESCRIPTION OF THE INVENTION

Figure 1:
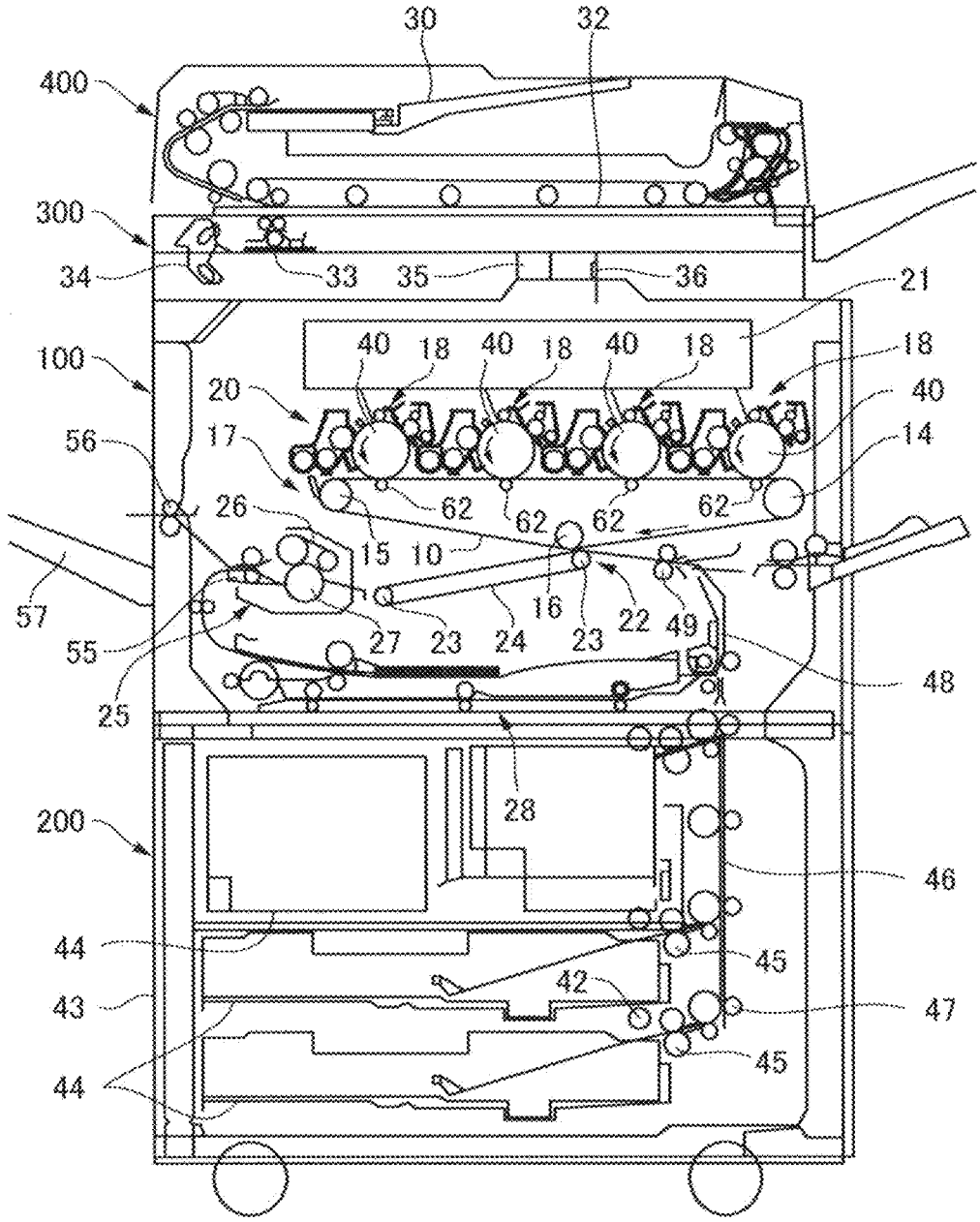
FIG. 1 is a diagram illustrating one example of an image forming apparatus.

Hereinafter, the present invention is explained in detail.

(Toner)

A toner of the present invention includes: a crystalline binder resin having a urethane bond or a urea bond, or both thereof; and a colorant, and it further includes other components according to necessity.

The colorant has a number-average particle diameter of 0.5 μm or less, and a ratio of particles having a particle diameter of 0.7 μm or greater in a number-size distribution is 5% by number or less. The number-average particle diameter and the particle diameter in the number-size distribution denote a particle diameter in a state where the colorant is dispersed in the toner, i.e. "dispersed particle diameter".

The number-average particle diameter of the colorant in the toner is 0.5 μm or less, and preferably 0.4 μm or less, and more preferably 0.3 μm or less. When the number-average particle diameter of the colorant exceeds 0.5 μm, dispersibility of the colorant is insufficient, which may impair color reproducibility. It is considered that a colorant having a particle diameter of less than 0.1 μm basically does not adversely affect reflection of light and absorbency. Colorant particles having a particle diameter of less than 0.1 μm contribute to favorable color reproducibility. On the other hand, when a colorant having a particle diameter exceeding 0.5 μm is abundant, brightness and vividness of an image tend to degrade, and color reproducibility may be impaired.

Further, a ratio of particles having particle diameter of 0.7 μm or greater in a number-size distribution of the colorant included in the toner particles is controlled to be 5% by number or less. Thereby, a toner having excellent low-temperature fixing property, charge stability and liquidity may be obtained, and at the same time, a toner which provides a high-quality image, especially a color image having favorable transparency and excellent gloss may be obtained.

The number-average particle diameter and the particle size distribution of the pigment in the toner may be measured as follows.

A measurement sample is prepared by subjecting the toner embedded in an epoxy resin to ultrathin sectioning using MICROTOME MT6000-XL (manufactured by Meiwafosis Co., Ltd.) to about 100 nm. Next, using an electron microscope (H-9000NAR, manufactured by Hitachi, Ltd.), TEM pictures of several samples are taken with an accelerating voltage of 100 kV and at a magnification of 10,000 to 40,000. The image information is converted to image data by an image processing and analysis apparatus LUZEX III of IMAGE ANALYZER. For target pigment particles, measurements are repeated by sampling at random exceeding 300 particles having a particle diameter of 0.1 μm or greater, and a number-average particle diameter and a particle size (particle diameter) distribution may be obtained.

In a diffraction spectrum of the toner of the present invention obtained by an x-ray diffraction method, a ratio [Cr/(Cr+Am)], where Cr is an integrated intensity of a spectrum derived from a crystalline structure of the binder resin, and Am is an integrated intensity of a spectrum derived from a non-crystalline structure, is not particularly restricted and may be appropriately selected according to purpose. Nonetheless, it is preferably 0.15 or greater in view of achieving both fixability and heat-resistant storage stability, more preferably 0.20 or greater, further more preferably 0.30 or greater, and particularly preferably 0.45 or greater.

Here, when the toner of the present invention includes a wax, a wax-specific diffraction peak often appears at 2θ=23.5° to 24°. However, when wax content with respect to a whole mass of the toner is less than 15% by mass, contribution of the wax-specific diffraction peak is small, and it does not have to be taken into account. When it is 15% by mass or greater, the "integrated intensity of a spectrum derived from a crystalline structure of the binder resin (Cr)" is replaced by a value obtained by subtracting integrated intensity of a spectrum derived from a crystalline structure of the wax from the integrated intensity of a spectrum derived from a crystalline structure of the wax.

The ratio [Cr/(Cr+Am)] is an indicator of an amount of a crystallization region in the toner (mainly an amount of a crystallization region in the binder resin as a main component of the toner). The x-ray diffraction measurement may be carried out using an x-ray diffractometer equipped with a 2-dimensional detector (D8 DISCOVER with GADDS manufactured by Bruker). Here, a conventionally known toner including a crystalline resin or a wax to an extent of an additive has this ratio of less than about 0.15.

For the measurement, a mark tube (Lindemann glass) having a diameter of 0.70 mm is used as a capillary. The sample is filled to an upper portion of this capillary tube for measurement. Also, it is tapped when the sample is filled, where the number of tapping is 100.

Detailed measurement conditions are described below.

Tube current: 40 mA

Tube voltage: 40 kV

Goniometer 2θ axis: 20.0000°

Goniometer Ω axis: 0.0000°

Goniometer ϕ axis: 0.0000°

Detector distance: 15 cm (wide-angle measurement)

Measurement range: 3.2≤2θ(°)≤37.2

Measurement time: 600 seconds

A collimator having pinhole with a diameter of 1 mm is used for an incident optical system. Obtained 2-dimensional data are integrated with a supplied software (at 3.2° to 37.2° in the x-axis) and converted to 1-dimensional data of a diffraction intensity and 2θ. Based on the obtained x-ray diffraction measurement results, a method for calculating the ratio [Cr/(Cr+Am)] is explained below.

Figure 7:
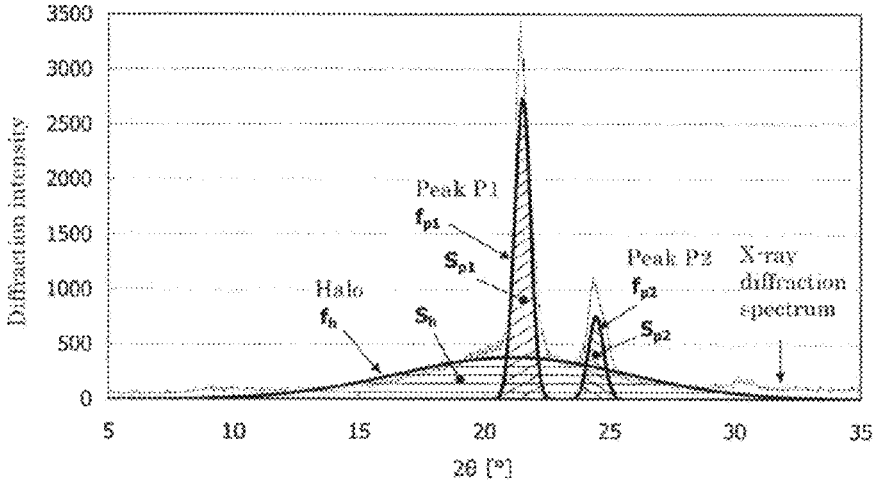
FIG. 7 is a diagram illustrating one example of a diffraction spectrum obtained by an x-ray diffraction measurement.
Figure 8:
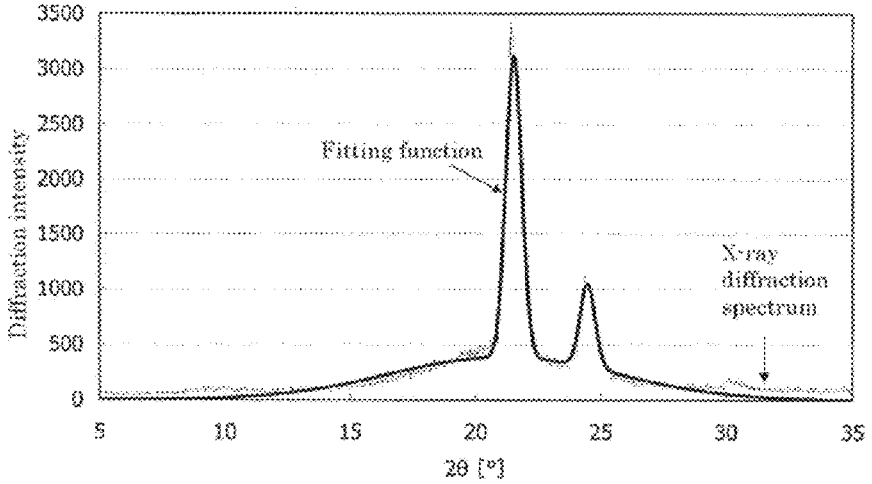
FIG. 8 is a diagram illustrating an example of a diffraction spectrum obtained by an x-ray diffraction measurement.

Examples of diffraction spectra obtained by an x-ray diffraction measurement are illustrated in FIG. 7 and FIG. 8. The horizontal axis represents 2θ(°), represents the x-ray diffraction intensity, and the both are linear axes. In the x-ray diffraction spectrum in FIG. 7, there are main peaks (P1, P2) at 2θ=21.3° and 24.2°, halos (h) are observed in a wide range including these two peaks. Here, the main peaks are derived from the crystalline structure while the halos are derived from the non-crystalline structure.

As shown by [Formula A1], [Formula A2], and [Formula A3] below, these two main peaks and halos are expressed by Gaussian functions fp1(2θ), fp2(2θ), fh(2θ). A sum of these three functions f(2θ) expressed by [Formula A4] below is regarded as a fitting function of the overall x-ray diffraction spectrum (see FIG. 8), and a fitting is carried out by a least square method.

$$fp1(2\theta)=ap1\exp\{-(2\theta-bp1)^2/(2cp1)^2\} \quad \text{Formula A1}$$

$$fp2(2\theta)=ap2\exp\{-(2\theta-bp2)^2/(2cp2)^2\} \quad \text{Formula A2}$$

$$fh(2\theta)=ah\exp\{-(2\theta-bh)^2/(2ch)^2\} \quad \text{Formula A3}$$

$$f(2\theta)=fp1(2\theta)+fp2(2\theta)+fh(2\theta) \quad \text{Formula A4}$$

There are 9 fitting variables, namely ap1, bp1, cp1, ap2, bp2, cp2, ah, bh and ch. As initial values of these variables for fitting, peak locations of the x-ray diffraction are set for bp1, bp2 and bh (in the example of FIG. 7, bp1=21.3, bp2=24.2, and bh=22.5), and appropriate values are input for the other variables so that the two main peaks and halos coincide as much as possible with the x-ray diffraction spectrum. The fitting may be carried out using a solver of Excel 2003, manufactured by Microsoft Corporation.

From the integrated areas (Sp1, Sp2, Sh) of fp1(2θ), fp2(2θ) and fh(2θ), respectively, after fitting are obtained, and the ratio [Cr/(Cr+Am)] as an indicator of an amount of the crystallization region may be calculated, assuming (Sp1+Sp2) is (Cr) and Sh is (Am).

Also, the toner of the present invention preferably has a relation between a concentration of urethane-urea groups (α) in the crystalline binder resin for a masterbatch (A) and a concentration of urethane-urea groups (β) in the crystalline binder resin (B) of β (% by mass)≤α (% by mass). Thereby, dispersibility of the colorant in the binder resin for a masterbatch improves, and the toner has excellent color reproducibility.

The concentration of urethane-urea groups in the binder resin is not particularly restricted and may be appropriately selected according to purpose. Nonetheless, it is preferably 2% by mass or greater in terms of heat-resistant storage stability of the toner, and more preferably 5% by mass or greater. As the ratio increases, compatibility of the colorant and the binder resin increases, and color reproducibility increases. An upper limit of α and β is around 13% by mass since decrease in the degree of crystallinity of the resin degrades low-temperature fixing property.

Also, by using a crystalline resin as the binder resin, the toner is superior in terms of low-temperature fixing property and heat-resistant storage stability.

Here, the concentration of urethane-urea groups is a value calculated from a charged amount in a resin synthesis by the following formula.

Concentration of urethane-urea groups (% by mass)= [NCO unit mass calculated from an amount of isocyanate used in the synthesis/a charged amount of the raw materials of the resin excluding a solvent (mass)]×100

The crystalline binder resin for a masterbatch (A) may be a resin composed only of a crystalline portion (aa), but it may also be a block resin composed of a crystalline portion (aa) and a non-crystalline portion (ab). A resin that the crystalline portion (aa) and the non-crystalline portion (ab) are linearly bound is preferable.

Also, the crystalline binder resin (B) may be a resin composed only of a crystalline portion (ba), but it may a block resin composed of a crystalline portion (ba) and a non-crystalline portion (bb). A resin that the crystalline portion (ba) and the non-crystalline portion (bb) are linearly bound is preferable.

When the crystalline binder resin (A) is a block resin composed of the crystalline portion (aa) and the non-crystalline portion (ab) and the crystalline binder resin (B) is a block resin composed of the crystalline portion (ba) and the non-crystalline portion (bb), a ratio of the crystalline portions (aa) or (ba) in the crystalline binder resin (A) or (B) is not particularly restricted and may be appropriately selected according to purpose. Nonetheless, it is preferably 50% by mass or greater, more preferably 60% by mass to 100% by mass, and further more preferably 70% by mass to 100% by mass. When the ratio of the crystalline portion is 50% by mass or greater, crystallinity of the resin is not impaired, and low-temperature fixing property is more favorable.

The "crystallinity" of a resin in the present invention is a characteristic of rapid softening due to heat that a ratio of a softening temperature measured by a capillary flow tester and a maximum peak temperature of a heat of fusion measured by a differential scanning calorimeter (DSC) (softening temperature/maximum peak temperature of a heat of fusion) is 0.8 to 1.55. A resin having this characteristic is referred to as a "crystalline resin".

Also, "non-crystallinity" is a characteristic of slow softening due to heat that the ratio of the softening temperature of the heat of fusion and the maximum peak temperature (softening temperature/maximum peak temperature of the heat of fusion) is greater than 1.55. A resin having this characteristic is referred to as a "non-crystalline resin".

Here, the softening temperature of the resin and the toner may be measured using a capillary flow tester (e.g. CFT-500D, manufactured by Shimadzu Corporation).

While 1 g of a resin as a sample is heated at a heating rate of 6° C./min, a load of 1.96 MPa is applied thereto using a plunger, and the sample is extruded from a nozzle having a diameter of 1 mm and a length of 1 mm. An amount of descent of the plunger of the flow tester is plotted against the temperature, and a temperature at which half of the sample elutes off is regarded as the softening temperature.

Also, the maximum peak temperature of the heat of fusion of the resin and the toner may be measured using a differential scanning calorimeter (DSC, e.g. TA-60WS and DSC-60, manufactured by Shimadzu Corporation).

As a pre-treatment, a sample for the measurement is melted at 130° C., cooled from 130° C. to 70° C. at a rate of 1.0° C./min, and next cooled from 70° C. to 10° C. at a rate of 0.5° C./min. Here, an endothermic-exothermic change is measured using a DSC by heating at a rate of 20° C./min. The "endothermic-exothermic change" is plotted against the "temperature", and an endothermic peak temperature observed at 20° C. to 100° C. is defined as "Ta*". When there are multiple endothermic peaks, a temperature having a peak with the largest endothermic quantity is defined as Ta*. Next, the sample is stored first at (Ta*−10)° C. for 6 hours, and then at (Ta*−15)° C. for 6 hours. Next, the sample is cooled to 0° C. at a cooling rate of 10° C./min by the DSC and then heated at a heating rate of 20° C./min, and an endothermic-exothermic change is measured. A similar plot is drawn, and a temperature corresponding to a maximum peak of an endothermic quantity is defined as a maximum peak temperature of a heat of fusion.

<Crystalline Resin>

The crystalline resin is not particularly restricted as long as it has crystallinity, and it may be appropriately selected according to purpose. Examples thereof include a polyester resin, a polyurethane resin, a polyurea resin, a polyamide resin, a polyether resin, a vinyl resin, and a modified crystalline resin.

These may be used alone or in combination of two or more. Among these, the polyester resin, the polyurethane resin, the polyurea resin, the polyamide resin, and the polyether resin are preferable. In particular, a resin having a urethane skeleton or a urea skeleton, or both thereof is preferable, and a straight-chain polyester resin and a composite resin having a straight-chain polyester resin are preferable.

Here, favorable examples of the resin having a urethane skeleton or a urea skeleton, or both thereof include a polyurethane resin, a polyurea resin, a urethane-modified polyester resin and a urea-modified polyester resin.

The urethane-modified polyester resin is a resin obtained by a reaction of a polyester resin having an isocyanate group at an end thereof with a polyol. Also, the urea-modified polyester resin is a resin obtained by a reaction of a polyester resin having an isocyanate group at an end thereof with amines.

The maximum peak temperature of the heat of fusion of the crystalline resin is not particularly restricted and may be appropriately selected according to purpose. Nonetheless, it is preferably 45° C. to 70° C., more preferably 53° C. to 65° C., and particularly preferably 58° C. to 62° C. in view of achieving both low-temperature fixing property and heat-resistant storage stability. When the maximum peak temperature is 45° C. or greater, heat-resistant storage stability does not degrade. When it is 70° C. or less, low-temperature fixing property does not degrade.

The ratio of the softening temperature and the maximum peak temperature of the heat of fusion of the crystalline resin (softening temperature/maximum peak temperature of the heat of fusion) is not particularly restricted and may be appropriately selected according to purpose. Nonetheless, it is preferably 0.8 to 1.55, more preferably 0.85 to 1.25, further more preferably 0.9 to 1.2, and particularly preferably 0.9 to 1.19. The resin has a characteristic of softening more sharply as the ratio decreases, which is superior in view of achieving low-temperature fixing property and heat-resistant storage stability.

Regarding viscoelastic properties of the crystalline resin, storage elastic modulus G' at (the maximum peak temperature of the heat of fusion)+20° C. is not particularly restricted and may be appropriately selected according to purpose. Nonetheless, it is preferably $5.0\times10^6$ Pa·s or less, more preferably $1.0\times10^1$ Pa·s to $5.0\times10^5$ Pa·s, and further more preferably $1.0\times10^1$ Pa·s to $1.0\times10^4$ Pa·s. Also, loss elastic modulus G" at (the maximum peak temperature of the heat of fusion)+20° C. is not particularly restricted and may be appropriately selected according to purpose. Nonetheless, it is preferably $5.0\times10^6$ Pa·s or less, more preferably $1.0\times10^1$ Pa·s to $5.0\times10^5$ Pa·s, and further more preferably $1.0\times10^1$ Pa·s to $1.0\times10^4$ Pa·s.

Considering that G' and G" increase when a colorant or a layered inorganic mineral is dispersed in the binder resin, the viscoelastic properties of the crystalline resin are preferably in the above ranges in view of fixing strength and hot-offset resistance.

The viscoelastic properties of the crystalline resin may be varied by adjusting ratios of a crystalline monomer and a non-crystalline monomer constituting the resin and a molecular weight of the resin. For example, when the ratio of the crystalline monomer is increased, the value of G' (Ta+20) decreases.

The dynamic viscoelastic properties (storage elastic modulus G', loss elastic modulus G") of the crystalline resin and the toner may be measured using a dynamic viscoelasticity measuring apparatus (ARES etc., manufactured by TA Instruments, Inc.).

For example, a sample is formed in pellets having a diameter of 8 mm and a thickness of 1 mm to 2 mm, fixed on a parallel plate having a diameter of 8 mm, which is then stabilized at 40° C., and heated to 200° C. at a heating rate of 2.0° C./min with a frequency of 1 Hz (6.28 rad/s) and a strain amount of 0.1% (strain amount control mode), and a measurement is taken.

A weight-average molecular weight (Mw) of the crystalline resin is not particularly restricted and may be appropriately selected according to purpose. Nonetheless, in view of fixability, it is preferably 2,000 to 100,000, more preferably 5,000 to 60,000, and particularly preferably 8,000 to 30,000. When the weight-average molecular weight is 2,000 or greater, hot-offset resistance does not degrade. When it is 100,000 or less, low-temperature fixing property does not degrade.

The weight-average molecular weight (Mw) may be measured using, for example, a gel permeation chromatography (GPC) measuring apparatus (e.g. GPC-8220GPC, manufactured by Tosoh Corporation).

For example, TSK-GEL SUPER HZM-H 15 cm in triplicate (manufactured by Tosoh Corporation) is used as a column, and a resin to be measured is dissolved in tetrahydrofuran (THF) (including a stabilizer, manufactured by Wako Pure Chemical Industries, Ltd.) to form a 0.15-% by mass solution. The solution is filtered using a 0.2-μm filter, and a filtrate thereof is used as a sample. Then, by injecting 100 μL of the THF sample solution in the measuring apparatus, a measurement is taken at a flow rate of 0.35 mL/min in an environment having a temperature of 40° C. In the molecular weight measurement of the sample, calculation is carried out from a relation between logarithmic values of calibration curves created from several monodispersed polystyrene standard samples and a number of counts.

As the standard polystyrene samples, SHOWDEX STANDARD Std. Nos. S-7300, S-210, S-390, S-875, S-1980, S-10.9, S-629, S-3.0, S-0.580 manufactured by Showa Denko KK are used. As a detector, an RI (refractive index) detector is used.

<<Polyester Resin>>

Examples of the polyester resin include a polycondensation polyester resin synthesized from a polyol and a polycarboxylic acid, a lactone ring-opening polymerization product, and polyhydroxycarboxylic acid. Among these, a polycondensation polyester resin of diol and dicarboxylic acid is preferably in view of development of crystallinity.

—Polyol—

Examples of the polyol include a diol and a polyol having 3 to 8 valences or greater.

The diol is not particularly restricted and may be appropriately selected according to purpose. Examples thereof include; aliphatic diols such as straight-chain aliphatic diol and branched-chain aliphatic diol; alkylene ether glycol having 4 to 36 carbon atoms; alicyclic diols having 4 to 36 carbon atoms; alkylene oxides (hereinafter abbreviated as AO) of the alicyclic diols; AO adducts of bisphenols; polylactone polybutadiene diols; diols having a carboxyl group, a sulfonic acid group or a sulfamic acid group, and diols having salts thereof and other functional groups. These may be used alone or in combination of two or more. Among these, an aliphatic diol having 2 to 36 chain carbon atoms is preferable, and a straight-chain aliphatic diol is more preferable.

A content of the straight-chain aliphatic diol with respect to the overall diol is not particularly restricted and may be appropriately selected according to purpose. Nonetheless, it is preferably 80% by mole or greater, and more preferably 90% by mole or greater. The content of 80% by mole or greater is preferable since crystallinity of the resin improves, low-temperature fixing property and heat-resistant storage stability may be achieved, and hardness of the resin tends to improve.

The straight-chain aliphatic diol is not particularly restricted and may be appropriately selected according to purpose. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. These may be used alone or in combination of two or more. Among these, ethylene glycol, 1,3-propanediol, 1,4-butanediol, 1,6-hexanediol, 1,9-nonanediol, and 1,10-decanediol are preferable, considering easy availability.

The branched-chain aliphatic diol having 2 to 36 chain carbon atoms is not particularly restricted and may be appropriately selected according to purpose. Examples thereof include propanediol, butanediol, hexanediol, octanediol, decanediol, dodecanediol, tetradecanediol, neopentyl glycol, 2,2-diethyl-1,3-propanediol other than the straight-chain aliphatic diol. These may be used alone or in combination of two or more.

The alkylene ether glycol having 4 to 36 carbon atoms is not particularly restricted and may be appropriately selected according to purpose. Examples thereof include diethylene glycol, triethylene glycol, dipropylene glycol, polyethylene glycol, polypropylene glycol, and polytetramethylene ether glycol.

The alicyclic diol having 4 to 36 carbon atoms is not particularly restricted and may be appropriately selected according to purpose. Examples thereof include 1,4-cyclohexane dimethanol and hydrogenated bisphenol A.

The alkylene oxides (hereinafter abbreviated as AO) of the alicyclic diol are not particularly restricted and may be appropriately selected according to purpose. Examples thereof include adducts (with addition of 1 to 30 moles) of ethylene oxide (hereinafter abbreviated as EO), propylene oxide (hereinafter abbreviated as PO) and butylene oxide (hereinafter abbreviated as BO).

The bisphenols are not particularly restricted and may be appropriately selected according to purpose. Examples thereof include AO (EO, PO, BO, etc.) adducts (with addition of 2 to 30 moles) of bisphenol A, bisphenol F and bisphenol S.

The polylactone diol is not particularly restricted and may be appropriately selected according to purpose. Examples thereof include poly-ϵ-caprolactone diol.

The diols having a carboxyl group are not particularly restricted and may be appropriately selected according to purpose. Examples thereof include a dialkylol alkanoic acid having 6 to 24 carbon atoms such as 2,2-dimethylol propionic acid (DMPA), 2,2-dimethylol butanoic acid, 2,2-dimethylol heptanoic acid, and 2,2-dimethylol octanoic acid.

The diols having a sulfonic acid group or the diols having a sulfamic acid group are not particularly restricted and may be appropriately selected according to purpose. Examples thereof include a sulfamic acid diol such as PO 2-mole adduct of N,N-bis(2-hydroxyethyl)sulfamic acid and N,N-bis(2-hydroxyethyl)sulfamic acid, N,N-bis(2-hydroxyalkyl)sulfamic acid (1 to 6 carbon atoms in the alkyl group) and an AO adduct thereof (AO may be EO, PO, etc. with addition of 1 to 6 moles of AO); and bis(2-hydroxyethyl)phosphate.

The diols having a carboxyl group, a sulfonic acid group or a sulfamic acid group may be used as a neutralized salt thereof. The neutralized salt is not particularly restricted and may be appropriately selected according to purpose. Examples thereof include a tertiary amine having 3 to 30 carbon atoms (triethylamine, etc.) and an alkali metal (sodium salt, etc.).

Among the polyols, an alkylene glycol having 2 to 12 carbon atoms, diols having a carboxyl group, an AO adduct of bisphenols, and a combination thereof are preferable.

Also, the polyol having 3 to 8 valences or greater used according to necessity is not particularly restricted and may be appropriately selected according to purpose. Examples thereof include; a polyhydric aliphatic alcohol having 3 to 8 valences or greater and having 3 to 36 carbon atoms including an alkane polyol and an intramolecular or intermolecular dehydration product thereof (e.g. glycerin, trimethylolethane, trimethylolpropane, pentaerythritol, sorbitol, sorbitan, polyglycerin, etc.), sugars and derivatives thereof (e.g. sucrose, methyl glucoside, etc.); an AO adduct (with addition of 2 to 30 moles) of trisphenols (trisphenol PA, etc.); an AO adduct (with addition of 2 to 30 moles) of a novolak resin (phenol novolak, cresol novolak, etc.); and an acrylic polyol such as copolymer of hydroxyethyl (meth)acrylate and other vinyl monomers. Among these, polyhydric aliphatic alcohol having 3 to 8 valences or greater and the AO adduct of a novolak resin are preferable, and the AO adduct of a novolak resin is more preferable.

—Polycarboxylic Acid—

Examples of the polycarboxylic acid include a dicarboxylic acid and a polycarboxylic acid having 3 to 6 valences or greater.

The dicarboxylic acid is not particularly restricted and may be appropriately selected according to purpose. Favorable examples thereof include: aliphatic dicarboxylic acids such as straight-chain aliphatic dicarboxylic acid and branched-chain aliphatic dicarboxylic acid; and aromatic dicarboxylic acids. Among these, a straight-chain aliphatic dicarboxylic acid is more preferable.

The aliphatic dicarboxylic acid is not particularly restricted and may be appropriately selected according to purpose. Favorable examples thereof include: alkanedicarboxylic acids having 4 to 36 carbon atoms such as succinic acid, adipic acid, sebacic acid, azelaic acid, octadecanedicarboxylic acid, octadecanedicarboxylic acid, decylsuccinic acid; alkanedicarboxylic acids having 4 to 36 carbon atoms such as alkenyl succinic acid including dodecenylsuccinic acid, pentadecenylsuccinic acid and octadecenylsuccinic acid, maleic acid, fumaric acid, and citraconic acid; and alicyclic dicarboxylic acids having 6 to 40 carbon atoms such as dimer acid (dimerized linoleic acid). These may be used alone or in combination of two or more.

The aromatic dicarboxylic acids are not particularly restricted and may be appropriately selected according to purpose. Favorable examples thereof include aromatic dicarboxylic acids having 8 to 36 carbon atoms such as phthalic acid, isophthalic acid, terephthalic acid, t-butylisophthalic acid, 2,6-naphthalenedicarboxylic acid, and 4,4'-biphenyldicarboxylic acid.

Also, examples of the polycarboxylic acid having 3 to 6 valences or greater used according to necessity include aromatic polycarboxylic acids having 9 to 20 carbon atoms such as trimellitic acid and pyromellitic acid.

Here, as the dicarboxylic acid or the polycarboxylic acid having 3 to 6 valences or greater, acid anhydrides or lower alkyl esters having 1 to 4 carbon atoms (methyl ester, ethyl ester, isopropyl ester, etc.) of those described above may be used.

Among the dicarboxylic acids, it is particularly preferable to use an aliphatic dicarboxylic acid (preferably, adipic acid, sebacic acid, dodecanedicarboxylic acid, terephthalic acid, isophthalic acid, etc.) alone, but a copolymer of an aromatic dicarboxylic acid (preferably, terephthalic acid, isophthalic acid, t-butylisophthalic acid, etc; lower alkyl esters of these aromatic dicarboxylic acids) with the aliphatic dicarboxylic acid is similarly preferable. An amount of copolymerization of the aromatic dicarboxylic acid is preferably 20% by mole or less.

—Lactone Ring-Opening Polymerization Product—

The lactone ring-opening polymerization product is not particularly restricted and may be appropriately selected according to purpose. Examples thereof include a lactone ring-opening polymerization product obtained by ring-opening polymerization of lactones including a monolactone having 3 to 12 carbon atoms (one ester group in the ring) such as β-propiolactone, γ-butyrolactone, δ-valerolactone and ϵ-caprolactone using a catalyst such as metal oxide and organic metal compound; and a lactone ring-opening polymerization product having a hydroxyl group at an end thereof obtained by ring-opening polymerization of the monolactones having 3 to 12 carbon atoms using a glycol (e.g. ethylene glycol, diethylene glycol, etc.) as an initiator.

The monolactone having 3 to 12 carbon atoms is not particularly restricted and may be appropriately selected according to purpose. Nonetheless, ϵ-caprolactone is preferable in view of crystallinity.

Also, commercially available products may be used as the lactone ring-opening polymerization product, and examples of the commercially available products include highly crystalline polycaprolactones such as H1P, H4, H5, H7, etc. of PLACCEL series manufactured by Daicel Corporation.

—Polyhydroxy Carboxylic Acid—

A method for preparing the polyhydroxy carboxylic acid is not particularly restricted and may be appropriately selected according to purpose. Examples thereof include: a method of direct dehydration condensation of hydroxycarboxylic acids such as glycolic acid and lactic acid (e.g. L-form, D-form and racemic form); and a method of ring-opening polymerization of a cyclic ester having 4 to 12 carbon atoms (having 2 to 3 ester groups in the ring) corresponding to a dehydration condensation product between 2 or 3 molecules of hydroxycarboxylic acid such as glycolide and lactide (e.g. L-form, D-form and racemic form) using a catalyst such as metal oxide and organometallic compound. Among these, the method of ring-opening polymerization is preferable in view of molecular weight adjustment.

Among the cyclic esters, L-lactide and D-lactide are preferable in view of crystallinity. Also, these polyhydroxy carboxylic acids may be those with their ends modified by a hydroxyl group or a carboxyl group.

<<Polyurethane Resin>>

Examples of the polyurethane resin include a polyurethane resin synthesized from a polyol such as diol and polyol having 3 to 8 valences or greater, and a polyisocyanate such as diisocyanate and polyisocyanate having 3 or more valences. Among these, a polyurethane resin synthesized from a diol and a diisocyanate is preferable.

Examples of the diol and the polyol having 3 to 8 valences or greater include the diols and the polyols having 3 to 8 valences or greater exemplified for the polyester resin.

—Polyisocyanate—

Examples of the polyisocyanate include a diisocyanate, and a polyisocyanate having 3 or more valences.

The diisocyanate is not particularly restricted and may be appropriately selected according to purpose. Examples thereof include aromatic diisocyanates, aliphatic diisocyanates, alicyclic diisocyanates, and aromatic-aliphatic diisocyanates. Among these diisocyanates, those preferable include: an aromatic diisocyanate having 6 to 20 carbon atoms, an aliphatic diisocyanate having 2 to 18 carbon atoms, an alicyclic diisocyanate having 4 to 15 carbon atoms, an aromatic aliphatic diisocyanate having 8 to 15 carbon atoms, where the number of carbon atoms excludes the carbon in the NCO group; a modified product of these diisocyanates (e.g. a urethane group, a carbodiimide group, an allophanate group, a urea group, a biuret group, an uretdione group, an uretoimin group, an isocyanurate group or an oxazolidone group); and a mixture of two or more types thereof. Also, an isocyanate having three or more valences may be used in combination according to necessity.

The aromatic diisocyanates are not particularly restricted and may be appropriately selected according to purpose. Examples thereof include 1,3- and/or 1,4-phenylene diisocyanate, 2,4- and/or 2,6-tolylene diisocyanate (TDI), crude TDI, 2,4'- and/or 4,4'-diphenylmethane diisocyanate (MDI), crude MDI [phosgene compound of crude diaminophenylmethane [condensation product of formaldehyde and aromatic amine (aniline) or a mixture thereof mixture of diaminodiphenylmethane and a small amount (5-20% by mass, for example) of a polyamine having three or more functional groups]=polyallyl polyisocyanate (PAPI)], 1,5-naphthylene diisocyanate, 4,4',4"-triphenylmethane diisocyanate, and m- and p-isocyanatophenyl sulfonyl isocyanate The aliphatic diisocyanates are not particularly restricted and may be appropriately selected according to purpose. Examples thereof include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, and 2-isocyanatoethyl-2,6-diisocyanato hexanoate.

The alicyclic diisocyanates are not particularly restricted and may be appropriately selected according to purpose. Examples thereof include isophorone diisocyanate (IPDI), diclohexylmethane-4,4'-diisocyanate (hydrogenated MDI), cyclohexylene diisocyanate, methyl cyclohexylene diisocyanate (hydrogenated TDI), bis(2-isocyanatoethyl)-4-cyclohexene-1,2-dicarboxylate, and 2,5- and 2,6-norbornane diisocyanate.

The aromatic aliphatic diisocyanates are not particularly restricted and may be appropriately selected according to purpose. Examples thereof include m- and p-xylylene diisocyanate (XDI) and α,α,α',α'-tetramethylxylylene diisocyanate (TMXDI).

Also, the modified product of a diisocyanate is not particularly restricted and may be appropriately selected according to purpose. Examples thereof include a modified product including a urethane group, a carbodiimide group, an allophanate group, a urea group, a biuret group, an uretdione group, an uretoimin group, an isocyanurate group or an oxazolidone group. Specific examples thereof include: a modified diisocyanate including modified MDI such as urethane-modified MDI, carbodiimide-modified MDI, trihydrocarbyl phosphate-modified MDI, and urethane-modified TDI such as prepolymer including isocyanate; and a mixture of two or more types of these modified diisocyanates (e.g. a combination of a modified MDI and a urethane-modified TDI).

Among these diisocyanates, an aromatic diisocyanate having 6 to 15 carbon atoms, an aliphatic diisocyanate having 4 to 12 carbon atoms and an alicyclic diisocyanate having 4 to 15 carbon atoms, where the number of carbon atoms excludes the carbon in the NCO group, are preferable, and TDI, MDI, HDI, hydrogenated MDI and IPDI are particularly preferable.

<<Polyurea Resin>>

Examples of the polyurea resin include polyurea resins synthesized from a polyamine such as diamine and polyamine having 3 or more valences and a polyisocyanate such as diisocyanate and polyisocyanate having 3 or more valences. Among these, a polyurea resin synthesized from a diamine and a diisocyanate is preferable.

Examples of the diisocyanate and the polyisocyanate having 3 or more valences include the diisocyanate and the polyisocyanate having 3 or more valences exemplified for the polyurethane resin.

—Polyamine—

Examples of the polyamine include a diamine and a polyamine having 3 or more valences.

The diamine is not particularly restricted and may be appropriately selected according to purpose. Examples thereof include aliphatic diamines and aromatic diamines. Among these, aliphatic diamines having 2 to 18 carbon atoms and aromatic diamines having 6 to 20 carbon atoms are preferable.

The aliphatic diamines having 2 to 18 carbon atoms are not particularly restricted and may be appropriately selected according to purpose. Examples thereof include: an alkylenediamine having 2 to 6 carbon atoms such as ethylenediamine, propylenediamine, trimethylenediamine, tetramethylenediamine and hexamethylenediamine; a polyalkylenediamine having 4 to 18 carbon atoms such as diethylenetriamine, iminobispropylamine, bis(hexamethylene)triamine, triethylenetetramine, tetraethylenepentamine and pentaethylenehexamine; a hydroxyalkyl substituent of the alkyelenediamine or the polyalkylenediamine by an alkyl group having 1 to 4 carbon atoms or a hydroxyalkyl group having 2 to 4 carbon atoms such as dialkylaminopropylamine, trimethylhexamethylenediamine, aminoethylethanolamine, 2,5-dimethyl-2,5-hexamethylenediamine and methyliminobispropylamine; an alicyclic diamine having 4 to 15 carbon atoms such as 1,3-diaminocyclohexane, isophorone diamine, menthenediamine and 4,4'-methylenedichylohexanediamine (hydrogenated methylenedianiline); a heterocyclic diamine having 4 to 15 carbon atoms such as piperazine, N-aminoethylpiperazine, 1,4-diaminoethylpiperazine, 1,4-bis(2-amino-2-methylpropyl)piperazine, 3,9-bis(3-aminopropyl)-2,4,8,10-tetraoxaspiro[5,5]undecane; and aliphatic amines including an aromatic ring having 8 to 15 carbon atoms such as xylylenediamine and tetrachloro-p-xylylenediamine. These may be used alone or in combination of two or more.

The aromatic diamines having 6 to 20 carbon atoms are not particularly restricted and may be appropriately selected according to purpose. Examples thereof include: non-substituted aromatic diamines such as 1,2-, 1,3- and 1,4-phenylenediamine, 2,4'- and 4,4'-diphenylmethanediamine, crude diphenylmethanediamine (polyphenylpolymethylenepolyamine), diaminodiphenyl sulfone, benzidine, thiodianiline, bis(3,4-di-aminophenyl)sulfone, 2,6-diaminopyridine, m-aminobenzylamine, triphenylmethane-4,4',4"-triamine and naphthylenediamine; aromatic diamines having nuclear-substituted alkyl group having 1 to 4 carbon atoms such as 2,4- and 2,6-triethylenediamine, crude tolylenediamine, diethyltolylenediamine, 4,4'-diamino-3,3'-dimethyldiphenylmethane, dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diamino diphenyl ether and 3,3',5,5'-tetraisopropyl-4,4'-diaminodiphenyl sulfone; mixtures of various ratios of the unsubstituted aromatic diamines or isomers of the aromatic diamines having nuclear-substituted alkyl group having 1 to 4 carbon atoms; methylenebis-o-chloroaniline, 4-chloro-o-phenylenediamine, 2-chloro-1,4-phenylenediamine, 3-amino-4-chloroaniline, 4-bromo-1,3-pehnylenediamine, 2,5-dichloro-1,4-phenylenediamine, 5-nitro-1,3-phenylenediamine and 3-dimethoxy-4-aminoaniline; aromatic diamines having nuclear substituted electron-withdrawing group (for example, halogens such as Cl, Br, I and F; alkoxy group such as methoxy and ethoxy groups; and nitro group) such as 4,4'-diamino-3,3'-dimethyl-5,5'-dibromodiphenylmethane, 3,3'-dichlorobenzidine, 3,3'-dimethoxybenzidine, bis(4-amino-3-chlorophenyl)oxide, bis(4-amino-2-chlorophenyl) propane, bis(4-amino-2-chlorophenyl) sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline) and 4-aminophenyl-2-chloroaniline; and aromatic diamines having a secondary amino group such as 4,4'-di(methylamino)diphenylmethane and 1-methyl-2-methylamino-4-aminobenzene [a part or all the primary amino group of the non-substituted aromatic diamine, the aromatic diamine having a nuclear-substituted alkyl group having 1 to 4 carbon atoms and a mixture of isomers thereof with various mixing ratios, and the aromatic diamine having a nuclear-substituted electron-withdrawing group is replaced by a secondary amino group with a lower alkyl group such as methyl and ethyl groups]. These may be used alone or in combination of two or more.

Other examples of the diamines include: polyamide polyamines such as low-molecular polyamide polyamine obtained by condensation of a dicarboxylic acid (e.g. dimer acid) with an excess amount of the polyamine (e.g. the alkylenediamine and the polyalkylenepolyamine); and a polyether polyamine such as hydrate of cyanoethylated polyether polyol (e.g. polyalkylene glycol).

<<Polyamide Resin>>

Examples of the polyamide resin include a polyamide resin synthesized from a polyamine such as diamine and a polyamine having 3 or more valences and a polycarboxylic acid such as dicarboxylic acid and a polycarboxylic acid having 3 to 6 valences or greater. Among these, a polyamide resin synthesized from a diamine and a dicarboxylic acid is preferable.

Examples of the diamine and the polyamine having 3 or more valences include the diamine and the polyamine having 3 or more valences exemplified for the polyurea resin.

Examples of the dicarboxylic acid and the polycarboxylic acid having 3 to 6 valences or greater include the dicarboxylic acid and the polycarboxylic acid having 3 to 6 valences or greater exemplified for the polyester resin.

<<Polyether Resin>>

The polyether resin is not particularly restricted and may be appropriately selected according to purpose. Examples thereof include a crystalline polyoxyalkylene polyol.

A method for manufacturing the crystalline polyoxyalkylene polyol is not particularly restricted, and a conventionally known method may be appropriately selected according to purpose. Examples thereof include; a method in which an AO of a chiral form of an AO is subject to ring-opening polymerization with a catalyst which is usually used for polymerization of an AO (disclosed in Journal of the American Chemical Society, 1956, Vol. 78, No. 18, pp. 4787-4792, for example); and a method in which an AO of an inexpensive racemic form is subject to ring-opening polymerization with a sterically bulky complex of a special chemical structure as a catalyst.

Also, as a method of using a special complex, a method of using as a catalyst a compound obtained by contacting a lanthanide complex and organic aluminum (disclosed in JP-A No. 11-12353, for example), and a method of reacting a bimetal-μ-oxo alkoxide and a hydroxyl compound in advance (disclosed in Japanese Patent Application Laid Open (JP-A) No. 2001-521957, for example) are known.

Also, as a method for obtaining a crystalline polyoxyalkylene polyol having an extremely high isotacticity, for example, a method of using a salen complex as a catalyst (disclosed in Journal of the American Chemical Society, 2005, Vol. 127, No. 33, pp. 11566-11567, for example) is known.

For example, when glycol or water is used as an initiator in a ring-opening polymerization of an AO of a chiral form, a polyoxyalkylene glycol having a hydroxyl group at an end thereof and having an isotacticity of 50% or greater is obtained. This polyoxyalkylene glycol may be that an end thereof is modified to have a carboxyl group, for example. Here, it is usually crystalline with an isotacticity of 50% or greater.

Also, examples of the glycol include the diols, and examples of a carboxylic acid used for carboxy-modification include the dicarboxylic acid.

An AO used for manufacturing the crystalline polyoxyalkylene polyol may be those having 3 to 9 carbon atoms. Examples thereof include PO, 1-chlorooxetane, 2-chlorooxetane, 1,2-dichlorooxetane, epichlorohydrin, epibromohydrin, 1,2-BO, methyl glycidyl ether, 1,2-pentyleneoxide, 2,3-pentyleneoxide, 3-methyl-1,2-butylene oxide, cyclohexeneoxide, 1,2-hexylene oxide, 3-methyl-1,2-pentyleneoxide, 2,3-hexylene oxide, 4-methyl-2,3-pentyleneoxide, aryl glycidyl ether, 1,2-heptylene oxide, styrene oxide, and phenyl glycidyl ether. Among these AO's, PO, 1,2-BO, styrene oxide and cyclohexane oxide are preferable, and PO, 1,2-BO and cyclohexane oxide are more preferable. Also, these AO's may be used alone or in combination of two or more.

Also, the isotacticity of the crystalline polyoxyalkylene polyol is not particularly restricted and may be appropriately selected according to purpose. Nonetheless, it is preferably 70% or greater, more preferably 80% or greater, particularly preferably 90% or greater, and most preferably 95% or greater in view of high sharp melting property and blocking resistance of the obtained crystalline polyether resin.

The isotacticity may be calculated in accordance with a method disclosed in Macromolecules, Vol. 35, No. 6, pp. 2389-2392 (2002) as follows.

About 30 mg of a measuring sample is weighed in a sample tube for $^{13}$C-NMR having a diameter of 5 mm, to which about 0.5 mL of a deuterated solvent is added for dissolution, and a sample for analysis is obtained. The deuterated solvent is not particularly restricted, and a solvent which dissolve the sample may be appropriately selected. Examples thereof include deuterated chloroform, deuterated toluene, deuterated dimethyl sulfoxide, and deuterated dimethylformamide Signals of 13C-NMR derived from the three methine groups may be observed around syndiotactic value (S) of 75.1 ppm, around heterotactic value (H) of 75.3 ppm, around isotactic value (I) of 75.5 ppm, respectively.

The isotacticity may be calculated by the following calculation formula.

$$\text{Isotacticity}(\%)=[I/(I+S+H)]\times 100$$

Here, in the calculation formula, "I" denotes an integral value of an isotactic signal, "S" denotes an integral value of a syndiotactic signal, and "H" denotes an integral value of an heteroisotactic signal.

<<Vinyl Resin>>

The vinyl resin is not particularly restricted as long as it has crystallinity, and it may be appropriately selected according to purpose. Nonetheless, a resin including a vinyl monomer having crystallinity and a vinyl monomer having no crystallinity according to necessity as structural units is preferable.

The vinyl monomer having crystallinity is not particularly restricted and may be appropriately selected according to purpose. Examples thereof include a straight-chain alkyl (meth)acrylate with the alkyl group having 12 to 50 carbon atoms (the straight-chain alkyl group having 12 to 50 carbon atoms is a crystalline group) such as lauryl(meth)acrylate, tetradecyl(meth)acrylate, stearyl(meth)acrylate, eicosyl (meth)acrylate, and behenyl(meth)acrylate.

The vinyl monomer having no crystallinity is not particularly restricted and may be appropriately selected according to purpose. Nonetheless, it is preferably a vinyl monomer having a molecular weight of 1,000 or less. Examples thereof include: styrenes, (meth)acrylic monomers, vinyl monomers including a carboxyl group, other vinyl ester monomers, and aliphatic hydrocarbon vinyl monomers. These may be used alone or in combination of two or more.

The styrenes are not particularly restricted and may be appropriately selected according to purpose. Examples thereof include styrene, and alkyl styrenes with the alkyl group having 1 to 3 carbon atoms.

The (meth)acrylic monomers are not particularly restricted and may be appropriately selected according to purpose. Examples thereof include alkyl(meth)acrylates with the alkyl group having 1 to 11 carbon atoms and branched alkyl(meth) acrylates with the alkyl group having 12 to 18 carbon atoms such as methyl (meth)acrylate, ethyl (meth)acrylate, butyl (meth)acrylate, 2-ethylhexyl (meth)acrylate; hydroxyalkyl (meth)acrylate with the alkyl group having 1 to 11 carbon atoms such as hydroxylethyl (meth)acrylate; and (meth)acrylates including an alkylamino group with the alkyl group having 1 to 11 carbon atoms such as dimethylaminoethyl (meth)acrylate and diethyl aminoethyl (meth)acrylate. These may be used alone or in combination of two or more.

The vinyl monomers including a carboxyl group are not particularly restricted and may be appropriately selected according to purpose. Examples thereof include: monocarboxylic acids having 3 to 15 carbon atoms such as (meth) acrylic acid, crotonic acid, and cinnamic acid; dicarboxylic acids having 4 to 15 carbon atoms such as maleic acid, maleic anhydride, fumaric acid, itaconic acid, and citraconic acid; and dicarboxylic acid monoesters including monoalkyl (having 1 to 18 carbon atoms) esters of the dicarboxylic acid such as maleic acid monoalkyl ester, fumaric acid monoalkyl ester, itaconic acid monoalkyl ester, citraconic acid monoalkyl ester. These may be used alone or in combination of two or more.

The other vinyl ester monomers are not particularly restricted and may be appropriately selected according to purpose. Examples thereof include: aliphatic vinyl esters having 4 to 15 carbon atoms such as vinyl acetate, vinyl propionate, and isopropenyl acetate; polyhydric (2 to 3 valences or greater) alcohol ester of an unsaturated carboxylic acid having 8 to 50 carbon atoms such as ethylene glycol di(meth) acrylate, propylene glycol di(meth)acrylate, neopentyl glycol di(meth)acrylate, trimethylolpropane tri(meth)acrylate, 1,6-hexanediol diacrylate, and polyethylene glycol di(meth)acrylate; and aromatic vinyl esters having 9 to 15 carbon atoms such as methyl-4-vinyl benzoate.

The aliphatic hydrocarbon vinyl monomers are not particularly restricted and may be appropriately selected according to purpose. Examples thereof include olefins having 2 to 10 carbon atoms such as ethylene, propylene, butane and octane; and dienes having 4 to 10 carbon atoms such as butadiene, isoprene and 1,6-hexadiene.

<<Modified Crystalline Resin (Binder Resin Precursor)>>

The modified crystalline resin is not particularly restricted as long as it is a crystalline resin having a functional group reactive with an active hydrogen group, and it may be appropriately selected according to purpose. Examples thereof include a crystalline polyester resin, a crystalline polyurethane resin, a crystalline polyurea resin, a crystalline polyamide resin, a crystalline polyether resin, and a crystalline vinyl resin having a functional group reactive with an active hydrogen group. The modified crystalline resin may form a binder resin by polymerizing a resin in a manufacturing process of a toner by reacting it with a resin having an active hydrogen group or a compound having an active hydrogen group such as crosslinking agent and elongation agent having an active hydrogen group. Accordingly, these modified crystalline resins may be used as a binder resin precursor in manufacturing a toner.

Here, the binder resin precursor denotes a compound which enables elongation or crosslinking reaction, including the monomers or oligomers constituting the binder resins, and the modified resins or oligomers having a functional group reactive with an active hydrogen group, and it may be a crystalline resin or a non-crystalline resin as long as it satisfies these conditions. Among these, as the binder resin precursor, a modified crystalline resin having an isocyanate group at least at an end thereof is preferable, and it preferably forms a binder resin as a result of elongation or crosslinking reaction by a reaction with an active hydrogen group when it disperses or emulsifies in an aqueous medium during granulation of toner particles.

As the binder resin formed by such a binder resin precursor, crystalline resins produced by an elongation or crosslinking reaction of a modified resin having a functional group reactive with an active hydrogen group with a compound having an active hydrogen group is preferable. Among these, a urethane-modified polyester resin produced by an elongation or crosslinking reaction of a polyester resin having an isocyanate group at an end thereof and the polyol, and a urea-modified polyester resin produced by an elongation or crosslinking reaction of a polyester resin having an isocyanate group at an end thereof with amines are preferable.

The functional group reactive with an active hydrogen group is not particularly restricted and may be appropriately selected according to purpose. Examples thereof include an isocyanate group, an epoxy group, a carboxylic acid group, and an acid chloride group. Among these, the isocyanate group is preferable in view of reactivity and stability.

The compound an active hydrogen group is not particularly restricted as long as it has an active hydrogen group, and it may be appropriately selected according to purpose. Examples thereof include compounds having a hydroxyl group (alcoholic hydroxyl group and phenolic hydroxyl group), an amino group, a carboxyl group, a mercapto group as an active hydrogen group, provided that the functional group reactive with an active hydrogen group is an isocyanate group. Among these, a compound having an amino group (i.e. amines) is particularly preferable in view of reaction speed.

The amines are not particularly restricted and may be appropriately selected according to purpose. Examples thereof include phenylene diamine, diethyl toluene diamine, 4,4'-diaminodiphenylmethane, 4,4'-diamino-3,3'-dimethyldicyclohexylmethane, diamine cyclohexane, isophorone diamine, ethylene diamine, tetramethylene diamine, hexamethylene diamine, diethylene triamine, triethylene tetramine, ethanolamine, hydroxyethylaniline, aminoethyl mercaptan, aminopropyl mercaptan, aminopropionic acid, and aminocaproic acid. Examples also includes ketimine compound and oxazoline compound that an amino group of these amines is blocked by ketones (acetone, methyl ethyl ketone, methyl isobutyl ketone, etc.).

The crystalline resin may be a block resin including a crystalline portion and a non-crystalline portion, the crystalline portion may be composed by the crystalline resin. A resin used for forming the non-crystalline portion is not particularly restricted and may be appropriately selected according to purpose. Examples thereof include a polyester resin, apolyurethane resin, a polyurea resin, a polyamide resin, a polyether resin, a vinyl resin (polystyrene, styrene acrylate polymer), and an epoxy resin.

Here, since a polyester resin, a polyurethane resin, a polyurea resin, a polyamide resin, and a polyether resin are preferable as the crystalline portion, it is preferable in view of compatibility that the resin used for forming the non-crystalline portion is also a polyester resin, a polyurethane resin, a polyurea resin, a polyamide resin, a polyether resin, and a complex resin thereof, and the polyurethane resin and the polyester resin are more preferable. A composition of these non-crystalline portions is not particularly restricted as long as it becomes a non-crystalline resin, and various combinations may be selected according to purpose. Examples of monomers to be used include the polyol, polycarboxylic acid, polyisocyanate, polyamine, and AO.

[Method for Manufacturing Block Polymer]

For a block polymer composed of the crystalline portion and the non-crystalline portion, whether or not to use a binding agent is determined in view of a reactivity of each terminal functional group, or when using a binding agent, a type of the binding agent which suits the terminal functional groups is selected, and the block polymer is produced by binding the crystalline portion and the non-crystalline portion.

When a binding agent is not used, a reaction of the terminal functional groups which form the crystalline portion of the resin and the terminal functional groups which form the non-crystalline portion is promoted under heating or reduced pressure according to necessity. Especially, for the cases of reacting an acid and an alcohol or reacting an acid and an amine, when one resin has a high acid value and the other resin has a high hydroxyl value or amine value, the reactions proceed smoothly. A reaction temperature is not particularly restricted and may be appropriately selected according to purpose. Nonetheless, it is preferably 180° C. to 230° C.

In the case of using a binding agent, various binding agents may be used. A dehydration reaction or an addition reaction may be carried out using polycarboxylic acid, polyhydric alcohols, polyvalent isocyanates, polyfunctional epoxys, or acid anhydrides.

Examples of the polycarboxylic acids and the acid anhydrides include those similar to the dicarboxylic acid component. Examples of the polyhydric alcohols include those similar to the diol component. Examples of the polyvalent isocyanates include those similar to the diisocyanate component. Examples of the polyfunctional epoxys include: bisphenol A-type and F-type epoxy compounds, phenol novolak-type epoxy compounds, cresol novolak-type epoxy compounds, hydrogenated bisphenol A-type epoxy compounds, diglycidyl ethers of an AO adduct of bisphenol A or F, diglycidyl ethers of an AO adduct of hydrogenated bisphenol A, diglycidyl ether of diols (e.g. ethylene glycol, propylene glycol, neopentyl glycol, butanediol, hexanediol, cyclohexane dimethanol, polyethylene glycol, and polypropylene glycol, etc.), trimethylolpropane di- and/or triglycidyl ether, pentaerythritol tri- and/or tetraglycidyl ether, sorbitol hepta- and/or hexaglycidyl ether, resorcin diglycidyl ether, dicyclopentadiene.phenol added-type glycidyl ether, methylenebis (2,7-dihydroxylnaphthalene)tetraglycidyl ether, 1,6-dihydroxylnaphthalenedi glycidyl ether, polybutadiene diglycidyl ether. These may be used alone or in combination of two or more.

Among the methods for binding the crystalline portion and the non-crystalline portion, an example of the dehydration reaction includes a method of binding the crystalline portion and the non-crystalline portion, both of which are alcohol resins at both ends, with a binding agent (e.g. polycarboxylic acid). In this case, for example, under no solvent, a block polymer may be obtained by reacting at a reaction temperature of 180° C. to 230° C.

Examples of the addition reaction include: a reaction to bind the crystalline portion and the non-crystalline portion, both of which are resins having a hydroxyl group at an end thereof, with a binding agent (e.g. polyisocyanate); and a reaction to bind the crystalline portion and the non-crystalline portion, one of which is a resin having a hydroxyl group at an end thereof and the other of which is a resin having an isocyanate group at an end thereof, without using a binding agent. In this case, for example, both the crystalline portion and the non-crystalline portion are dissolved in a solvent which may dissolve them, to which a binding agent is added according to necessity, the solution is reacted at a reaction temperature of 80° C. to 150° C., and a block polymer may be obtained.

As the crystalline resin, the block polymer is preferable, but a resin which includes no non-crystalline portion and is composed only of a crystalline portion may also be used.

Examples of a composition of the resin composed only of a crystalline portion include those similar to the resin which constitutes the crystalline portion, and a crystalline vinyl resin.

As the crystalline vinyl resin, a resin having a vinyl monomer including a crystalline group (m) and a vinyl monomer including no crystalline group (n) according to necessity as structural unit is preferable.

Examples of the vinyl monomer (m) include: a straight-chain alkyl (meth)acrylate (m1) with the alkyl group having 12 to 50 carbon atoms (a straight-chain alkyl group having 12 to 50 carbon atoms is the crystalline group); and a vinyl monomer (m2) having a unit of the crystalline portion (b).

As the crystalline vinyl resin, the vinyl monomer (m) more preferably includes a straight-chain alkyl(meth)acrylate with the alkyl group having 12 to 50 (preferably 16 to 30) carbon atoms (m1).

Examples of the (m1) include: lauryl(meth)acrylate, tetradecyl(meth)acrylate, stearyl(meth)acrylate, eicosyl(meth) acrylate, and behenyl(meth)acrylate, where the respective alkyl group are a straight-chain group.

Here, in the present invention, the alkyl(meth)acrylate denotes an alkyl acrylate and/or alkyl methacrylate, and the same notation is used hereinafter.

Regarding the vinyl monomer (m2) having a unit of a crystalline portion, as a method to introduce the unit of a crystalline portion to the vinyl monomer, whether or not to use a binding agent (coupling agent) is determined in view of a reactivity of each terminal functional group, or when using a binding agent, a type of the binding agent which suits the terminal functional groups is selected, and the vinyl monomer having a unit of a crystalline portion (m2) is produced by binding the crystalline portion and the vinyl monomer.

When a binding agent is not used for preparation of the (m2), a reaction of the terminal functional groups of the crystalline portion of the resin and the terminal functional groups of the vinyl monomer is promoted under heating or reduced pressure according to necessity. Especially, for the cases of reacting a carboxyl group and a hydroxyl group or reacting a carboxyl group and an amino group as the terminal functional groups, when one resin has a high acid value and the other resin has a high hydroxyl value or amine value, the reactions proceed smoothly. The reaction temperature is not particularly restricted and may be appropriately selected according to purpose. Nonetheless, it is preferably 180° C. to 230° C.

In the case of using a binding agent, various binding agents may be used in accordance with the types of the terminal functional groups.

Specific examples of the binding agent and a method for preparing a vinyl monomer (m2) using a binding agent include those exemplified for the method for manufacturing a block polymer.

The vinyl monomer including no crystalline group (n) is not particularly restricted and may be appropriately selected according to purpose. Examples thereof include: vinyl monomer (n1) having a molecular weight of 1,000 or less used usually for manufacturing a vinyl resin other than the vinyl monomer including a crystalline group (m); and a vinyl monomer including a unit of the non-crystalline portion (n2).

Examples of the vinyl monomer (n1) include styrenes, (meth)acrylic monomers, vinyl monomers including a carboxyl group, other vinyl ester monomers, and aliphatic hydrocarbon vinyl monomers. These may be used alone or in combination of two or more.

Examples of the styrenes include styrene, an alkylstyrene with an alkyl group having 1 to 3 carbon atoms [e.g. α-methylstyrene and p-methylstyrene], and styrene is preferable.

Examples of the (meth)acrylic monomers include: alkyl (meth)acrylates with the alkyl group having 1 to 11 carbon atoms, and branched alkyl(meth)acrylates with the alkyl group having 12 to 18 carbon atoms [e.g. methyl (meth) acrylate, ethyl (meth)acrylate, butyl (meth)acrylate and 2-ethylhexyl(meth)acrylate], hydroxylalkyl(meth)acrylates with the alkyl group having 1 to 11 carbon atoms [e.g. hydroxylethyl (meth)acrylate], (meth)acrylate including an alkylamino group with the alkyl group having 1 to 11 carbon atoms [e.g. dimethylaminoethyl (meth)acrylate and diethylaminoethyl (meth)acrylate], and vinyl monomers including a nitrile group [e.g. acrylonitrile and methacrylonitrile]. These may be used alone or in combination of two or more.

Examples of the vinyl monomers having a carboxyl group include: monocarboxylic acids [having 3 to 15 carbon atoms, e.g. (meth)acrylic acid, crotonic acid, cinnamic acid], dicarboxylic acids [having 4 to 15 carbon atoms, e.g. maleic acid, maleic anhydride, fumaric acid, itaconic acid, citraconic acid], dicarboxylic acid monoester [monoalkyl (having 1 to 18 carbon atoms) ester of the dicarboxylic acid, e.g. maleic acid monoalkyl ester, fumaric acid monoalkyl ester, itaconic acid monoalkyl ester, citraconic acid monoalkyl ester].

Examples of other vinyl ester monomers include aliphatic vinyl esters [having 4 to 15 carbon atoms, e.g. vinyl acetate, vinyl propionate, isopropenyl acetate], unsaturated carboxylic acid polyhydric (2 to 3 valences or greater) alcohol esters [having 8 to 50 carbon atoms, e.g. ethylene glycol di(meth) acrylate, propylene glycol di(meth)acrylate, neopentyl glycol di(meth)acrylate, trimethylolpropane tri(meth)acrylate, 1,6-hexanediol diacrylate, polyethylene glycol di(meth)acrylate], and aromatic vinyl esters [having 9 to 15 carbon atoms, e.g. methyl-4-vinylbenzoate].

Examples of the aliphatic hydrocarbon vinyl monomer include olefins [having 2 to 10 carbon atoms, e.g. ethylene, propylene, butene, octene], dienes (having 4 to 10 carbon atoms, e.g. butadiene, isoprene, 1,6-hexadiene].

Among these (b1)'s, (meth)acrylic monomer, and the vinyl monomer having a carboxyl group are particularly preferable.

In the vinyl monomer having a unit of a non-crystalline portion (n2), examples of a method for introducing the unit of a non-crystalline portion to the vinyl monomer include those exemplified as a method for introducing the unit of a crystalline portion to the vinyl monomer in the vinyl monomer having a unit of a crystalline portion (m2).

A ratio of the constitutional unit of the vinyl monomer including a crystalline group (m) in the crystalline vinyl resin is not particularly restricted and may be appropriately selected according to purpose. Nonetheless, it is preferably 30% by mass or greater, more preferably 35% by mass to 95% by mass, and more preferably 40% by mass to 90% by mass. In this range, crystallinity of the vinyl resin is not impaired, and heat-resistant storage stability is favorable. Also, a content of the straight-chain alkyl(meth)acrylate with the alkyl group having 12 to 50 carbon atoms (m1) in (m) is not particularly restricted and may be appropriately selected according to purpose. Nonetheless, it is preferably 30% by mass to 100% by mass, and more preferably 40% by mass to 80% by mass.

By polymerizing these vinyl monomers with a heretofore known method, a crystalline vinyl resin may be obtained.

The crystalline resin may be used alone as a resin which constitutes the crystalline resin particles of the present invention, but it may be used along with a non-crystalline resin.

The non-crystalline resin is not particularly restricted and may be appropriately selected according to purpose. Nonetheless, examples thereof include a polyester resin, a polyurethane resin, an epoxy resin and a vinyl resin having a number-average molecular weight (hereinafter denoted as Mn) of 1,000 to 1,000,000, and a combination thereof. The polyester resin and the vinyl resin are preferable, and the polyester resin is more preferable. Here, in view of low-temperature fixing property and gloss, a ratio of the crystalline resin in the resin is not particularly restricted and may be appropriately selected according to purpose. Nonetheless, it is preferably 60% by mass or greater, more preferably 65% by mass or greater, and further more preferably 70% by mass or greater.

<Non-Crystalline Resin>

The non-crystalline resin is not particularly restricted as long as it is non-crystalline, and it may be appropriately selected from heretofore known resins according to purpose. Examples thereof include: homopolymers of styrene or a substitution product thereof such as polystyrene, poly-p-styrene, and polyvinyltoluene, styrene copolymers such as styrene-p-chlorostyrene copolymer, styrene-propylene copolymer, styrene-vinyltoluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isopropyl copolymer, styrene-maleic acid ester copolymer, a polymethyl methacrylate resin, a polybutyl methacrylate resin, a polyvinyl chloride resin, a polyvinyl acetate resin, a polyethylene resin, a polyester resin, a polyurethane resin, an epoxy resin, a polyvinyl butyral resin, polyacrylic acid, a rosin resin, a modified rosin resin, a terpene resin, a phenol resin, an aliphatic or aromatic hydrocarbon resin, an aromatic petroleum resin, and compounds that these resins are modified to have a functional group reactive with an active hydrogen group. These may be used alone or in combination of two or more.

<Colorant>

The colorant is not particularly restricted and may be appropriately selected from heretofore known dyes and pigments according to purpose. Examples thereof include carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Yellow L, Benzidine Yellow (G, GR), Permanent Yellow (NCG) (NCG), Vulcan Fast Yellow (5G, R), tartrazine lake, quinoline yellow lake, Anthrazane Yellow BGL, isoindolinone yellow, colcothar, red lead, lead vermilion, cadmium red, cadmium mercury red, antimony vermilion, Permanent Red 4R, Para Red, fiser red, para-chloro-ortho-nitro aniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Lithol Rubin GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, lithopone. These may be used alone or in combination of two or more.

A color of the colorant is not particularly restricted and may be appropriately selected according to purpose. Examples thereof include a black colorant and colorant with colors such as magenta, cyan and yellow. These may be used alone or in combination of two or more.

Examples of the black colorant include carbon black such as furnace black, lampblack, acetyleneblack, and channel black (C. I. PIGMENT BLACK 7), metals such as copper, iron (C. I. PIGMENT BLACK 11) and titanium oxide, and organic pigments such as aniline black (C. I. PIGMENT BLACK 1).

Examples of the magenta colorant include C. I. PIGMENT RED 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 163, 177, 179, 202, 206, 207, 209, 211; C. I. PIGMENT VIOLET 19; C. I. VAT RED 1, 2, 10, 13, 15, 23, 29, 35.

Examples of the cyan colorant include C. I. PIGMENT BLUE 2, 3, 15, 15:1, 15:2, 15:3, 15:4, 15:6, 16, 17, 60; C. I. VAT BLUE 6; C. I. ACID BLUE 45 or a copper phthalocyanine pigment substituted with 1 to 5 phthalimidemethyl groups in phthalocyanine skeleton, GREEN 7, GREEN 36.

Examples of the yellow colorant include C. I. PIGMENT YELLOW 0-16, 1, 2, 3, 4, 5, 6, 7, 10, 11, 12, 13, 14, 15, 16, 17, 23, 55, 65, 73, 74, 83, 97, 110, 151, 154, 180; C. I. VAT YELLOW 1, 3, 20, ORANGE 36.

A content of the colorant in the toner is not particularly restricted and may be appropriately selected according to purpose. Nonetheless, it is preferably 1% by mass to 15% by mass, and more preferably 3% by mass to 10% by mass. When the content is 1% by mass or greater, coloring strength of the toner does not degrade. When it is 15% by mass or less, degradation of coloring strength or decrease of electrical characteristics of the toner due to poor dispersion of the colorant in the toner does not occur.

The colorant may also be used as a masterbatch as a combination with a resin. As the resin, those having a configuration similar to those for the toner may be favorably used. By using the resin having a similar configuration, the masterbatch mixes with the binder resin, and dispersibility of the colorant improves. Further, when a concentration of urethane-urea groups in the masterbatch resin is greater than a concentration of urethane-urea groups in the binder resin, dispersibility of the colorant in the masterbatch resin improves due to the urethane-urea group as a polar group, and the favorable dispersibility of the colorant may be maintained after it is formed into a toner. As a result, color reproducibility of the toner improves.

The masterbatch may be manufactured by melting or kneading a resin for a masterbatch and the colorant with an application of high shear force. To enhance an interaction between the colorant and the resin, an organic solvent is preferably added. Also, a so-called flushing method is favorable since a wet cake of the colorant may be used as it is, without necessity of drying. The flushing method is a method of mixing or kneading an aqueous paste of the colorant including water with a resin and an organic medium to remove the water and the organic medium by transferring the colorant to the resin. For mixing or kneading, for example, a high shear dispersing apparatus such as three-roll mill may be used.

<Other Components>

The toner of the present invention may include, within a range that the effects of the present invention are not impaired, other components other than the binder resin and the colorant, other components such as releasing agent, charge controlling agent, external additive, fluidity improving agent, cleanability improving agent, magnetic material and organically modified layered inorganic mineral according to necessity.

<<Releasing Agent>>

The releasing agent is not particularly restricted and may be appropriately selected from heretofore known ones according to purpose. Examples thereof include wax including waxes such as wax including a carbonyl group, polyolefin wax and long-chain hydrocarbon. These may be used alone or in combination of two or more. Among these, the wax including a carbonyl group is preferable.

Examples of the wax including a carbonyl group include polyalkanoic acid ester, polyalkanol ester, polyalkanoic acid amide, polyalkyl amide and dialkyl ketone.

Examples of the polyalkanoic acid ester include carnauba wax, montan wax, trimethylolpropane tribehenate, pentaerythritol tetra behenate, pentaerythritol diacetate dibehenate, glycerin tribehenate and 1,18-octadecanediol distearate. Examples of the polyalkanol ester include trimellitic acid tristearyl and distearyl maleate. Examples of the polyalkanoic acid amide include dibehenyl amide. Examples of the polyalkyl amide include trimellitic acid tristearyl amide. Examples of the dialkyl ketone include distearyl ketone. Among these waxes including a carbonyl group, a polylalkanoic acid ester is particularly preferable.

Examples of the polyolefin wax include polyethylene wax and polypropylene wax.

Examples of the long-chain hydrocarbon include paraffin wax and Sasol wax.

A melting point of the releasing agent is not particularly restricted and may be appropriately selected according to purpose. Nonetheless, it is preferably 40° C. to 160° C., more preferably 50° C. to 120° C., and particularly preferably 60° C. to 90° C.

The melting point is less than 40° C. may adversely affect heat-resistant storage stability, and the melting point exceeding 160° C. may cause cold offset during low-temperature fixing.

The melting point of the releasing agent may be measured as follows, for example. A sample, which has been heated first to 200° C. using a differential scanning calorimeter (DSC210, manufactured by Seiko Denshi Kogyo Co., Ltd.) and then cooled from the temperature to 0° C. at a cooling rate of 10° C./min, is heated at a heating rate of 10° C./min, and a maximum peak temperature of the heat of fusion may be obtained as the melting point.

A melt viscosity of the releasing agent is, as a measured value at a temperature higher by 20° C. than the melting point of the wax, preferably 5 cps to 1,000 cps, and more preferably 10 cps to 100 cps. The melt viscosity of less than 5 cps may degrade releasing property. When the melt viscosity exceeds 1,000 cps, effects of improving hot-offset resistance and low-temperature fixing property may not be obtained.

A content of the releasing agent in the toner is not particularly restricted and may be appropriately selected according to purpose. Nonetheless, it is preferably 40% by mass or less, and more preferably 3% by mass to 30% by mass. When the content exceeds 40% by mass, liquidity of the toner may degrade.

<<Charge Controlling Agent>>

The charge controlling agent is not particularly restricted and may be appropriately selected from heretofore known ones according to purpose. Nonetheless, since a colored material may alter a color tone, a material which is colorless or close to white is preferable. Examples of such a charge controlling agent include triphenylmethane dyes, molybdic acid chelate pigments, rhodamine dyes, alkoxy amines, quaternary ammonium salts (including fluorine-modified quaternary ammonium salts), alkyl amides, elemental phosphorus or phosphorus compound, elemental tungsten or tungsten compounds, fluorine surfactants, metal salts of salicylic acid, and metal salts of salicylic acid derivatives. These may be used alone or in combination of two or more.

As the charge controlling agent, commercially available products may be used. Examples of the commercially available products include: BONTRON P-51 of a quaternary ammonium salt, BONTRON E-82 of an oxynaphthoic acid metal complex, BONTRON E-84 of a salicylic acid metal complex, and BONTRON E-89 of a phenolic condensation product (manufactured by Orient Chemical Industries Co., Ltd.), TP-302, TP-415 of quaternary ammonium salt molybdenum complex (manufactured by Hodogaya Chemical Co., Ltd.), Copy charge PSY VP2038 of a quaternary ammonium salt, Copy Blue PR of a triphenylmethane derivative, Copy Charge NEG VP2036, Copy Charge NX VP434 of quaternary ammonium salts, (manufactured by Hoechst); LRA-901, LR-147 as a boron complex (manufactured by Cara Japan Co., Ltd.); quinacridone, azo pigments, and polymeric compounds having a functional group such as sulfonic acid group, carboxyl group and quaternary ammonium salt.

The charge controlling agent may be subject to melt-kneading along with the masterbatch and then dissolved or dispersed, it may be added along with the components of the toner when dissolved or dispersed, or it may be fixed on a surface of the toner after manufacturing the toner particles.

A content of the charge controlling agent in the toner varies depending on the types of the binder resin, presence of additives, and dispersion method, etc., and it cannot be defined unconditionally. Nonetheless, it is preferably 0.1 parts by mass to 10 parts by mass, and more preferably 0.2 parts by mass to 5 parts by mass with respect to 100 parts by mass of the binder resin. When the content is less than 0.1 parts by mass, charge controllability may not be obtained. When it exceeds 10 parts by mass, chargeability of the toner may become too large, which reduces an effect of the main charge controlling agent and increases an electrostatic attraction force with a developing roller, leading to a decrease in image density and decrease in liquidity of the developer.

<<External Additives>>

The external additive is not particularly restricted and may be appropriately selected from heretofore known ones according to purpose. Nonetheless, examples thereof include, silica particles, hydrophobized silica particles, fatty acid metal salt (e.g. zinc stearate, aluminum stearate); metal oxides (e.g. titanium oxide, alumina, tin oxide, antimony oxide), hydrophobized metal oxide particles, fluoropolymer. Among these, hydrophobized silica particles, hydrophobized titanium oxide particles, hydrophobized alumina particles are favorable.

Examples of the silica particles include HDK H 2000, HDK H 2000/4, HDK H 2050EP, HVK21, HDK H1303 (manufactured by Hoechst); R972, R974, RX200, RY200, R202, R805, R812 (manufactured by Nippon Aerosil Co., Ltd.).

Examples of the titanium oxide particles include P-25 (manufactured by Nippon Aerosil Co., Ltd.), STT-30, STT-65C-S (manufactured by Titan Kogyo, Ltd.), TAF-140 (manufactured by Fuji Titanium Industry Co., Ltd.), MT-150W, MT-500B, MT-600B, MT-150A (manufactured by Tayca Corporation).

Examples of the hydrophobized titanium oxide particles include T-805 (manufactured by Nippon Aerosil Co., Ltd.); STT-30A, S17-65S-S (manufactured by Titan Kogyo, Ltd.); TAF-500T, TAF-1500T (manufactured by Fuji Titanium Industry Co., Ltd.); MT-100S, MT-100T (manufactured by Tayca Corporation), IT-S (manufactured by Ishihara Sangyo Kaisha Ltd.).

The hydrophobized silica particles, hydrophobized titanium oxide particles, and hydrophobized alumina particles may be obtained by processing hydrophilic particles such as silica particles, titanium oxide particles and alumina particles with a silane coupling agent such as methyltrimethoxysilane, methyltriethoxysilane and octyltrimethoxysilane.

Also, as the external additive, inorganic particles processed with a silicone oil that inorganic particles are processed with a silicone oil with heating according to necessity are also preferable.

As the silicone oil, dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohol-modified silicone oil, amino-modified silicone oil, epoxy-modified silicone oil, epoxy.polyether-modified silicone oil, phenol-modified silicone oil, carboxyl-modified silicone oil, mercapto-modified silicone oil, acryl- or methacryl-modified silicone oil, or α-methyl styrene modified silicone oil may be used.

Examples of the silicone oil include dimethyl silicone oil, methylphenyl silicone oil, chlorophenyl silicone oil, methylhydrogen silicone oil, alkyl-modified silicone oil, fluorine-modified silicone oil, polyether-modified silicon oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl- or methacryl-modified silicone oil and α-methylstyrene-modified silicone oil. Examples of the inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, red iron oxide, antimony trioxide, magnesium oxide, zirconium oxide, barium sulfate, barium carbonate, calcium carbonate, silicon carbide and silicon nitride. Among these, silica and titanium dioxide are particularly preferable.

An added amount of the external additive is not particularly restricted and may be appropriately selected according to purpose. Nonetheless, it is preferably 0.1% by mass to 5% by mass, and more preferably 0.3% by mass to 3% by mass with respect to the toner.

A number-average particle diameter of primary particles of the inorganic particles has is not particularly restricted and may be appropriately selected according to purpose. Nonetheless, it is preferably 100 nm or less, and more preferably 3 nm to 70 nm. When the number-average particle diameter is less than 3 nm, the inorganic particles are embedded in the toner, and its function is less likely to be effectively exhibited. When it exceeds 70 nm, a surface of a electrostatic latent image bearing member is non-uniformly scratched, which is not preferable.

As the external additive, the inorganic particles and hydrophobized inorganic particles are used in combination, and a number-average particle diameter of the hydrophobized primary particles is not particularly restricted and may be appropriately selected according to purpose. Nonetheless, it is preferably 1 nm to 100 nm, and among them, it is more preferable to include at least two types of inorganic particles having a number-average particle diameter of 5 nm to 70 nm. Further, it is more preferable to include at least two types of inorganic particles having a number-average particle diameter of the hydrophobized primary particles of 20 nm or less and at least one type of inorganic particles having a number-average particle diameter of 30 nm or greater. Also, a specific surface area by a BET method is not particularly restricted and may be appropriately selected according to purpose. Nonetheless, it is preferably 20 $m^2/g$ to 500 $m^2/g$.

Examples of a surface treatment agent for the external additive including oxide particles include silane coupling agent such as dialkyl dihalogenated silane, trialkyl halogenated silane, alkyl trihalogenated silane and hexaalkyldisilazane, silylating agent, silane coupling agent having a fluorinated alkyl group, organic titanate coupling agent, aluminum-based coupling agent, silicone oil and silicone varnish.

As an external additive, resin particles may also be added. Examples of the resin particles include: polystyrene obtained by soap-free emulsion polymerization, suspension polymerization, or dispersion polymerization; a copolymer of methacrylic acid ester or acrylic acid ester; polycondensation polymer particles of silicone benzoguanamine or nylon; and polymer particles by a thermosetting resin. With these resin particles used in combination, chargeability of the toner may be enhanced, an oppositely charged toner may be reduced, and background smear may be reduced. An added amount of the resin particles is not particularly restricted and may be appropriately selected according to purpose. Nonetheless, it is preferably 0.01% by mass to 5% by mass, and more preferably 0.1% by mass to 2% by mass with respect to the whole toner.

<<Fluidity Improving Agent>>

The fluidity improving agent means an agent which increases hydrophobicity by a surface treatment of the toner and prevents degradation of fluidity properties and charge properties of the toner even under high humidity. Examples thereof include a silane coupling agent, a silylating agent, a silane coupling agent having a fluorinated alkyl group, an organic titanate coupling agent, an aluminum-based coupling agent, a silicone oil, and a modified silicone oil.

<<Cleanability Improving Agent>>

The cleanability improving agent is added to the toner in order to remove a developer remaining after transfer on an electrostatic latent image bearing member or an intermediate transfer member. Examples thereof include: a metal salt of a fatty acid such as stearic acid, including zinc stearate and calcium stearate; and polymer particles obtained by soap-free emulsion polymerization of methyl methacrylate particles or polystyrene particles.

The polymer particles preferably have a relatively narrow particle size distribution, and those having a mass-average particle diameter of 0.01 μm to 1 μm are preferable.

<<Magnetic Material>>

The magnetic material is not particularly restricted and may be appropriately selected from heretofore known ones according to purpose. Examples thereof include iron powder, magnetite, and ferrite. Among these, white ones are preferable in view of color tone.

[Method for Manufacturing Toner]

A method for manufacturing a toner of the present invention is not particularly restricted and may be appropriately selected according to purpose. Examples thereof include kneading and pulverization method and a method to granulate toner particles in an aqueous medium (chemical method).

The kneading and pulverization method is a method for manufacturing toner base particles by pulverizing and classifying melt-kneaded a toner material including at least a colorant and a binder resin.

In the melt-kneading, the toner material is mixed, and the mixture is charged in a melt-kneader for melt-kneading. As a melt-kneader, a uniaxial or biaxial continuous kneader and a batch kneader with a roll mill may be used. Favorable examples thereof include: a KTK-model twin-screw extruder manufactured by Kobe Steel, Ltd.; a TEM-model extruder manufactured by Toshiba Machine Co., Ltd.; a twin-screw extruder manufactured by KCK Co., Ltd.; a PCM-model twin-screw extruder manufactured by Ikegai Corporation; and a co-kneader, manufactured by Buss. It is preferable to carry out this melt-kneading under appropriate conditions so as not to cut off the molecular chains of the binder resin. Specifically, a melt-kneading temperature is set by reference to a softening point of the binder resin. When it is too high compared to the softening point, the resin is severely cut off. When it is too low, dispersion may not proceed.

In the pulverization, the melt-kneaded matter is pulverized. In this pulverization, it is preferable that coarse pulverization is followed by fine pulverization. Favorable examples of such a pulverization method include: a method to pulverize by collision with a collision plate in a jet stream; a method to pulverize by collision among particles in a jet stream; and a method to pulverize in a narrow gap between a mechanically rotating rotor and a stator.

In the classification, a pulverized matter obtained in the pulverization is classified so as to adjust the particles having a predetermined particle diameter. The classification may be carried out by removing fine particles using a cyclone, a decanter, or a centrifuge.

After completion of the pulverization and classification, the pulverized matter is classified in a jet stream by a centrifugal force, and toner base particles having a predetermined particle diameter may be manufactured.

The chemical method is not particularly restricted and may be appropriately selected according to purpose. Examples thereof include: a suspension polymerization method, an emulsion polymerization method, a seed polymerization method, a dispersion polymerization method, etc. in which a monomer is a starting material for manufacturing; a dissolution suspension method in which a binder resin or a binder resin precursor is dissolved or dispersed in an organic solvent, which is dispersed or emulsified in an aqueous medium; a phase inversion emulsification method to invert phases by adding water to a solution including a binder resin, a binder resin precursor and a suitable emulsifier; and an agglomeration method in which the binder resin particles obtained by these methods are agglomerated by heat-melting, etc. in a state that they are dispersed in an aqueous medium to granulate them to particles of a desired size. Among these, a toner obtained by the dissolution suspension method is more preferable in view of granulation property by the crystalline binder resin (easiness of controlling a particle size distribution, controlling a particles shape).

A method for manufacturing resin particles including a binder resin is not particularly restricted and may be appropriately selected according to purpose. Examples thereof include (a) to (h) below.

(a) In the case of a vinyl resin, with a monomer as a starting material, an aqueous dispersion solution of resin particles is manufactured directly by a polymerization reaction such as suspension polymerization method, emulsion polymerization method, seed polymerization method, and dispersion polymerization method.

(b) In the case of a polyaddition or condensation resin such as polyester resin, polyurethane resin, and epoxy resin, a precursor (monomer, oligomer, etc.) or a solvent solution thereof is dispersed in an aqueous medium in the presence of an appropriate dispersant, which is then hardened by heating or adding a hardener, and an aqueous dispersion of resin particles is manufactured.

(c) In the case of a polyaddition or condensation resin such as polyester resin, polyurethane resin, and epoxy resin, an appropriate emulsifier is dissolved in a precursor (monomer, oligomer, etc.) or a solvent solution thereof (it is preferably a liquid, and one obtained by liquefying by heating is also allowable), to which water is added for phase inversion.

(d) Resin particles are obtained by pulverizing a resin prepared in advance by a polymerization reaction (any polymerization reaction such as addition polymerization, ring-opening polymerization, polyaddition, addition condensation, condensation polymerization) using a mechanically rotating mill or a jet mill, followed by classification, which is then dispersed in water in the presence of an appropriate dispersant.

(e) Resin particles are obtained by spraying a resin solution that a resin prepared in advance by a polymerization reaction (any polymerization reaction such as addition polymerization, ring-opening polymerization, polyaddition, addition condensation, condensation polymerization) is dissolved in a solvent, followed by dispersing them in water in a presence of an appropriate dispersant.

(f) Resin particles are obtained by adding a solvent to a resin solution that a resin prepared in advance by a polymerization reaction (any polymerization reaction such as addition polymerization, ring-opening polymerization, polyaddition, addition condensation, condensation polymerization) is dissolved in a solvent or precipitating the resin particles by cooling the resin solution that the resin solution is heated and dissolved in a solvent in advance, from which the solvent is removed, followed by dispersing them in water in a presence of an appropriate dispersant.

(g) A resin solution that a resin prepared in advance by a polymerization reaction (any polymerization reaction such as addition polymerization, ring-opening polymerization, polyaddition, addition condensation, condensation polymerization) is dissolved in a solvent is dispersed in an aqueous medium in a presence of an appropriate dispersant, from which the solvent is removed by heating or by reducing a pressure.

(h) An appropriate emulsifier is dissolved in a resin solution that a resin prepared in advance by a polymerization reaction (any polymerization reaction such as addition polymerization, ring-opening polymerization, polyaddition, addition condensation, condensation polymerization) is dissolved in a solvent, followed by addition of water for phase inversion emulsification.

Also, in emulsification or dispersion in an aqueous medium, a surfactant or a polymeric protective colloid may be used according to necessity.

—Surfactant—

The surfactant is not particularly restricted and may be appropriately selected according to purpose. Examples thereof include: an anionic surfactant such as alkylbenzene sulfonate, α-olefin sulfonate, and a phosphoric acid ester; a cationic surfactant including amine salt type such as alkylamine salt, amino alcohol fatty acid derivative, polyamine fatty acid derivative and imidazoline, and quaternary ammonium salt type such as alkyltrimethyl ammonium salt, dialkyldimethyl ammonium salt, alkyldimethylbenzyl ammonium salt, pyridinium salt, alkyl iso-quinolinium salt and benzethonium chloride; a non-ionic surfactant such as fatty acid amide derivative and polyhydric alcohol derivative; and an amphoteric surfactant such as alanine, dodecyldi(aminoethyl)glycine, di(octyl aminoethyl)glycine and N-alkyl-N,N-dimethyl ammonium betaine.

Also, use of a surfactant having a fluoroalkyl group even in a very small amount can increase an effect thereof. Examples of the surfactant having a fluoroalkyl group include an anionic surfactant having a fluoroalkyl group and a cationic surfactant having a fluoroalkyl group.

Examples of the anionic surfactant having a fluoroalkyl group include a fluoroalkylcarboxylic acid having 2 to 10 carbon atoms and a metal salt thereof, disodium perfluorooctane sulfonylglutamate, sodium 3-[ω-fluoroalkyl (C6 to C11) oxy]-1-alkyl (C3 to C4) sulfonate, sodium 3-[ω-fluoroalkanoyl (C6 to C8)-N-ethylamino]-1-propanesulfonate, fluoroalkyl (C11 to C20) carboxylic acid and a metal salt thereof, perfluoroalkylcarboxylic acid (C7 to C13) and a metal salt thereof, perfluoroalkyl (C4 to C12) sulfonic acid and a metal salt thereof, perfluorooctanesulfonic acid diethanolamide, N-propyl-N-(2-hydroxyethyl)perfluorooctanesulfonamide, perfluoroalkyl (C6 to C10) sulfonamidepropyltrimethylammonium salt, perfluoroalkyl (C6 to C10)-N-ethylsulfonylglycine salt, and monoperfluoroalkyl (C6 to C16) ethylphosphoric acid ester.

Examples of the cationic surfactant having a fluoroalkyl group include aliphatic quaternary ammonium salts such as aliphatic primary or secondary amine acid having a fluoro alkyl group and perfluoroalkyl (C6 to C10) sulfonamidepropyl trimethyl ammonium salt, benzalkonium salts, benzethonium chloride, pyridinium salts, and imidazolinium salts.

—Polymeric Protective Colloid—

The polymeric protective colloid is not particularly restricted and may be appropriately selected according to purpose. Examples thereof include: acids such as acrylic acid, methacrylic acid, α-cyano acrylic acid, α-cyano methacrylic acid, itaconic acid, crotonic acid, fumaric acid, maleic acid and maleic anhydride; (meth)acrylic monomers having a hydroxyl group such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic acid ester, diethylene glycol monomethacrylic acid ester, glycerin monoacrylic acid ester, glycerin monomethacrylic acid ester, N-methylol acrylamide and N-methylol methacrylamide; vinyl alcohol; ethers with vinyl alcohol such as vinyl methyl ether, vinyl ethyl ether and vinyl propyl ether; esters of vinyl alcohol with a compound having a carboxyl group such as vinyl acetate, vinyl propionate and vinyl butyrate; acrylamide, methacrylamide, diacetone acrylamide, and a methylol compound thereof; acid chlorides such as acrylic acid chloride and methacrylic acid chloride; homopolymers or copolymers of those having a nitrogen atom or a heterocyclic ring thereof such as vinyl pyridine, vinyl pyrrolidone, vinyl imidazole and ethylene imine; polyoxyethylenes such as polyoxyethylene, polyoxypropylene, polyoxyethylene alkylamine, polyoxypropylene alkylamine, polyoxyethylene alkyl amide, polyoxypropylene alkylamide, polyoxyethylene nonylphenyl ether, polyoxyethylene laurylphenyl ether, polyoxyethylene stearylphenyl ester and polyoxyethylene nonylphenyl ester; and celluloses such as methyl cellulose, hydroxyethyl cellulose and hydroxypropyl cellulose.

—Organic Solvent—

The organic solvent used for dissolving or dispersing a toner composition including the binder resin, the binder resin precursor, the colorant and the organically modified layered inorganic mineral preferably has a volatility that its boiling point is less than 100° C. in view of easy removal of the solvent later.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These may be used alone or in combination of two or more. Among these, ester solvents such as methyl acetate and ethyl acetate, aromatic solvents such as toluene and xylene, and halogenated hydrocarbon such as methylene chloride, 1,2-dichloroethane, chloroform, and carbon tetrachloride are preferable.

A solid content concentration of an oil phase obtained by dissolving or dispersing the toner composition including the binder resin, binder resin precursor and colorant is not particularly restricted and may be appropriately selected according to purpose. Nonetheless, it is preferably 40% by mass to 80% by mass. When the concentration is too high, the dissolution or dispersion becomes difficult, or the oil phase becomes difficult to handle due to high viscosity. When the concentration is too low, an amount of toner production is reduced.

The toner materials other than the resin such as colorant and the masterbatch thereof may be individually dissolved or dispersed in the organic solvent, which is then mixed in the resin solution or dispersion.

—Aqueous Medium—

The aqueous medium may be water alone, or a solvent which is miscible with water may be used in combination. Examples of the solvent miscible with water include alcohols (e.g. methanol, isopropanol, ethylene glycol, etc.), dimethylformamide, tetrahydrofuran, cellosolves (e.g. methyl cellosolve, etc.), lower ketones (e.g. acetone, methyl ethyl ketone, etc.).

An amount of the aqueous medium used with respect to 100 parts by mass of the toner composition is not particularly restricted and may be appropriately selected according to purpose. Nonetheless, it is preferably 50 parts by mass to 2,000 parts by mass, and more preferably 100 parts by mass to 1,000 parts by mass. When the amount used is less than 50 parts by mass, toner particles having a desired particle diameter cannot be obtained due to poor dispersion of the toner composition. Also, the amount used exceeding 2,000 parts by mass is not economical.

An inorganic dispersant or organic resin particles may be dispersed in advance in the aqueous medium, which is preferable in view of sharp particle size distribution and dispersion stability.

Examples of the inorganic dispersant include tricalcium phosphate, calcium carbonate, titanium oxide, colloidal silica and hydroxyapatite.

A resin which forms the organic resin particles is not particularly restricted as long as it forms an aqueous dispersion, and it may be a thermoplastic resin or a thermosetting resin. Examples thereof include a vinyl resin, a polyurethane resin, an epoxy resin, a polyester resin, a polyimide resin, a polyimide resin, a silicon-based resin, a phenol resin, a melamine resin, a urea resin, an aniline resin, an ionomer resin and a polycarbonate resin. These resins may be used alone or in combination of two or more.

Among these, the vinyl resin, the polyurethane resin, the epoxy resin, the polyester resin and a combination thereof are preferable since an aqueous dispersion of fine spherical resin particles may be easily obtained.

A method for emulsifying or dispersing in the aqueous medium is not particularly restricted and may be appropriately selected according to purpose, and a heretofore known equipment such as low-speed shearing equipment, high-speed shearing equipment, friction equipment, high-pressure jet equipment and ultrasonic waves may be used. Among these, the high-speed shearing equipment is preferable in view of obtaining reduced particle diameter. When the high-speed sharing dispersion equipment is used, the rotational speed is not particularly restricted and may be appropriately selected according to purpose. Nonetheless, it is preferably 1,000 rpm to 30,000 rpm, and more preferably 5,000 rpm to 20,000 rpm. A temperature during dispersion is not particularly restricted and may be appropriately selected according to purpose. Nonetheless, it is preferably 0° C. to 150° C. (under pressurization), and more preferably 20° C. to 80° C.

When the binder resin precursor is included in the toner composition, the compound having an active hydrogen group, etc. required by the binder resin precursor for elongation or crosslinking reaction may be mixed in advance in the oil phase prior to dispersing the toner composition in the aqueous medium, or it may be mixed in the aqueous medium.

In order to remove the organic solvent from the obtained emulsification dispersion, a heretofore known method may be used. For example, a whole system is gradually heated under a normal pressure or a reduced pressure, and the organic solvent in liquid droplets is completely removed by evaporation.

When the agglomeration method is used in the aqueous medium, a resin particles dispersion, a colorant dispersion and an organically modified layered inorganic mineral dispersion obtained by the above methods and a dispersion of a releasing agent, etc. according to necessity are mixed and agglomerated together for granulation. The resin particles dispersion may be alone, or two or more types of resin particles dispersions may be added. They may be added at once or added separately in several times. The same applies to the other dispersions.

A state of agglomeration may be controlled preferably by heating, adding a metal salt, or adjusting a pH.

The metal salt is not particularly restricted and may be appropriately selected according to purpose. Examples thereof include: a monovalent metal constituting a salt of sodium and potassium, etc.; a divalent metal constituting a salt of calcium and magnesium, etc.; and a trivalent metal constituting a salt of aluminum, etc.

Examples of the anions constituting the salts include a chloride ion, a bromide ion, an iodide ion, a carbonate ion and a sulfate ion.

Among these, magnesium chloride, aluminum chloride, and a complex or a multimer thereof are preferable.

Also, heating during agglomeration or after completion of agglomeration may promote fusion among resin particles, which is preferable in view of toner uniformity. Further, a shape of the toner may be controlled by heating, and usually, the toner becomes close to spherical usually by heating.

A heretofore known technology is used for washing and drying the toner base particles dispersed in the aqueous medium. That is, a solid-liquid separation is carried out with a centrifuge or a filter press, etc., then an obtained toner cake is re-dispersed in deionized water of about a normal temperature to about 40° C., which is subject to pH control with an acid or alkali according to necessity, and a solid-liquid separation is carried out again. These steps are repeated to remove impurities or the surfactant. This is followed by drying with a flash dryer, a circulation dryer, a vacuum drier or a vibration fluidized dryer, etc. to obtain toner powder. Here, a fine particle component of the toner may be removed by centrifuge, or the toner after drying may be subjected to classification using a heretofore classifier according to necessity for a desired particle diameter distribution.

By mixing the toner powder obtained after drying with different kinds of particles such as charge controlling particles and fluidizing particles or by applying a mechanical impact on the mixed powder, the different kinds of particles are fixed and fused on a surface, and separation of the different kinds of particles from the surface of the obtained composite particles may be prevented.

Examples of specific means include: a technique to apply an impact force to a mixture using blades rotating at high speed; and a technique to put the mixture in a high-speed airflow, which is accelerated to have the particles collide with one another or against a suitable collision plate.

Examples of an apparatus include ANGMILL (manufactured by Hosokawa Micron Co., Ltd.), a remodeled apparatus of I-TYPE MILL (manufactured by Nippon Pneumatic Mfg. Co., Ltd.) with a reduced grinding air pressure, HYBRIDIZATION SYSTEM (manufactured by Nara Kikai Seisakusho Co., Ltd.), KRYPTRON SYSTEM (manufactured by Kawasaki Heavy Industries, Ltd.) and an automatic mortar.

(Developer)

A developer of the present invention includes a toner of the present invention, and it further includes other components appropriately selected according to necessity.

The developer may be a one-component developer or a two-component developer, but it is preferably the two-component developer in view of improving lifetime when it is used in a high-speed printer which complies with improved information processing speed in recent years.

For a one-component developer, even after the toner is balanced, i.e. supply of the toner to the developer and consumption of toner by development are carried out, variation of the particle diameter of the toner is small. Also, it does not cause filming on a developing roller or fuse on a layer regulating member such as blades for thinning the toner, and favorable and stable developing property may be achieved even after a long-term usage (stirring) in a developing device.

Also, for the two-component developer, variation of the particle diameter of the toner is small when the toner in the developer is balanced over a long period of time, and favorable and stable developing property may be achieved even after a long-term stirring in a developing unit.

<Carrier>

The carrier is not particularly restricted and may be appropriately selected according to purpose. Nonetheless, it preferably includes a core material and a resin layer which coats the core material.

A material of the core material is not particularly restricted and may be appropriately selected from heretofore known materials. A manganese-strontium (Mg—Sr) material and a manganese-magnesium (Mn—Mg) material of 50 emu/g to 90 emu/g are preferable. In view of ensuring an image density, a high-magnetization material such as iron powder (100 emu/g or greater) and magnetite (75 emu/g to 120 emu/g) is preferable. Also, a low-magnetization material such as copper-zinc (Cu—Zn) material (30 emu/g to 80 emu/g) is preferable since it is advantageous in terms of image quality by weakening the toner in a state of ear standing on a photoconductor. These may be used alone or in combination of two or more.

A particle diameter of the core material, which is an average particle diameter [mass-average particle diameter (D50)], is not particularly restricted and may be appropriately selected according to purpose. Nonetheless, it is preferably 10 μm to 200 μm, and more preferably 40 μm to 100 μm. When the average particle diameter is less than 10 μm, fine powder increases in a distribution of the carrier particles, and magnetization per one particle may decrease. This may result in carrier scattering. When it exceeds 200 μm, specific surface area decreases, which may result in toner scattering. In a full-color printing having many solid portions, reproduction of the solid portions may degrade in particular.

A material for the resin layer is not particularly restricted, and it may be appropriately selected from heretofore known resins according to purpose. Examples thereof include an amino resin, a polyvinyl resin, a polystyrene resin, a halogenated olefin resin, a polyester resin, a polycarbonate resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoro-terpolymer (fluorinated triple (multiple) copolymer) such as terpolymer of tetrafluoroethylene, vinylidene fluoride and non-fluorinated monomer, and a silicone resin. These may be used alone or in combination of two or more. Among these, the silicone resin is particularly preferable.

The silicone resin is not particularly restricted, and it may be appropriately selected from generally known silicone resins according to purpose. Examples thereof include: a straight silicone resin consisting of organosiloxane bonds and silicone resins modified by an alkyd resin, a polyester resin, an epoxy resin, an acrylic resin or a urethane resin.

As the silicone resin, commercially available products may be used. For the commercially available products, examples of the straight silicone resin include: KR271, KR255, KR152 manufactured by Shin-Etsu Chemical Co., Ltd.; and SR2400, SR2406, SR2410 manufactured by Dow Corning Toray Co., Ltd.

Also, examples of the modified silicone resin include: KR206 (alkyd-modified), KR5208 (acrylic-modified), ES1001N (epoxy-modified), KR305 (urethane-modified) manufactured by Shin-Etsu Chemical Co., Ltd.; and SR2115 (epoxy-modified), SR2110 (alkyd-modified) manufactured by Dow Corning Toray Co., Ltd.

Here, the silicone resins may be used alone, but it may also be used in combination with a crosslinking component or a charge controlling component.

The resin layer may include an electrically conductive powder according to necessity, and examples of the electrically conductive powder include a metal powder, carbon black, titanium oxide, tin oxide and zinc oxide. These electrically conductive powders have an average particles diameter of preferably or less. When the average particles diameter exceeds it may become difficult to control an electrical resistance.

The resin layer may be formed, for example, by dissolving the silicone resin, etc. in a solvent to prepare a coating solution, followed by applying the coating solution uniformly on a surface of the core material by a heretofore known coating method, which is dried and baked. Examples of the coating method include a dipping method, a spraying method and a brushing method.

The solvent is not particularly restricted and may be appropriately selected according to purpose. Examples thereof include toluene, xylene, methyl ethyl ketone, methyl isobutyl ketone, cellosolve and butyl acetate.

The baking is not particularly restricted and may be appropriately selected according to purpose. It may be an external heating method or an internal heating method. Examples thereof include methods using a stationary electric furnace, a fluidized electric furnace, a rotary electric furnace or a burner furnace and a method using microwave.

A ratio of the resin layer in the carrier is not particularly restricted and may be appropriately selected according to purpose. Nonetheless, it is preferably 0.01% by mass to 5.0% by mass. When the ratio is less than 0.01% by mass, a uniform resin layer may not be formed on a surface of the core material. When it exceeds 5.0% by mass, the resin layer is too thick, causing agglomeration within the carrier, and uniform carrier particles may not be obtained.

When the developer is a two-component developer, a content of the carrier in the two-component developer is not particularly restricted and may be appropriately selected according to purpose. Nonetheless, it is preferably 90% by mass to 98% by mass, and more preferably 93% by mass to 97% by mass.

A mixing ratio of the toner and the carrier in the two-component developer is not particularly restricted and may be appropriately selected according to purpose. In general, 1.0 part by mass to 10.0 parts by mass of the toner with respect to 100 parts by mass of the carrier is preferable.

(Image Forming Method)

An image forming method of the present invention includes at least an electrostatic latent image formation step, a developing step, a transfer step, and a fixing step. The developing step is carried out using a developing unit including a developer bearing member which includes an internally fixed magnetic field generating unit and which carries a developer including a magnetic carrier and a toner on a surface thereof and rotates. As the developer, the two-component developer of the present invention is used. Thereby, the image forming method has superior low-temperature fixing property and is energy-saving.

Also, it is possible to prepare a process cartridge which is detachably mounted on an image forming apparatus main body, wherein the process cartridge includes a developing unit which forms a visible image by developing an electrostatic latent image formed on an electrostatic latent image bearing member using the two-component developer of the present invention.

<Image Forming Apparatus>

An image forming apparatus used for the image forming method of the present invention includes at least an electrostatic latent image bearing member, a charging unit, an exposure unit, a developing unit, a transfer unit, and a fixing unit, and it further includes other units according to necessity.

The developing unit is a unit which develops an electrostatic latent image using a toner to form a visible image.

Here, FIG. 1 is a schematic diagram illustrating one example of a two-component developing apparatus using a two-component developer including a toner and a magnetic carrier. This image forming apparatus is equipped with a copying apparatus main body 100, a paper feed table 200, a scanner 300, and an automatic document feeder (ADF) 400.

In the copying apparatus main body 100, an intermediate transfer member 10 having a shape of an endless belt is disposed at a center thereof. Also, the intermediate transfer member 10 is stretched by support rollers 14, 15 and 16, rotatable in a clockwise direction in FIG. 1. In a vicinity of the support roller 15, an intermediate transfer member cleaning unit 17 is disposed for removing a residual toner on the intermediate transfer member 10. On the intermediate transfer member 10 stretched by the support roller 14 and the support roller 15, a tandem developing device 20 is disposed to which four image forming units 18 of yellow, cyan, magenta and black are disposed in parallel along its conveying direction. In the vicinity of the tandem developing device 20, an exposure device 21 is disposed. On a side opposite to the side on which the tandem developing device 20 is disposed in intermediate transfer member 10, a secondary transfer unit 22 is disposed. In the secondary transfer unit 22, a secondary transfer belt 24 as an endless belt is stretched by a pair of rollers 23, and a recording medium conveyed on the secondary transfer belt 24 and the intermediate transfer member 10 may be in contact with each other. In the vicinity of the secondary transfer unit 22, a fixing unit 25 is disposed.

Here, in the image forming apparatus, in the vicinity of the secondary transfer unit 22 and the fixing unit 25, an inverting apparatus 28 which inverts a recording medium is disposed for forming images on both surfaces of the recording medium.

Next, formation of a full-color image using the tandem developing device 20 is explained.

That is, first, a document is set on a document table 30 of the automatic document feeder (ADF) 400. Alternatively, the automatic document feeder 400 is opened, the document is set on a contact glass 32 of the scanner 300, and the automatic document feeder 400 is closed. A start button (not shown) is pressed. The scanner 300 activates after the document is conveyed and transferred to the contact glass 32 in the case the document has been set on the automatic document feeder 400, or right away in the case the document has been set on the contact glass 32, and a first traveling body 33 and a second travelling body 34 travel. At this time, a light from a light source is irradiated by the first traveling body 33, and a reflected light from a surface of the document is reflected by a mirror in the second travelling body 34, which is received by a reading sensor 36 through an imaging lens 35. The color document (color image) is read thereby, and black, yellow, magenta and cyan image information may be obtained. Each of black, yellow, magenta and cyan image information is transmitted to the respective image forming unit 18 in the tandem developing device 20, and black, yellow, magenta and cyan toner images are formed in the respective image forming units.

That is, each image forming unit 18 in the tandem developing device 20 includes, as illustrated in FIG. 1; an electrostatic latent image bearing member 40 (photoconductor); a charger (not shown) which uniformly charges the electrostatic latent image bearing member; an exposure device 21 which carries out an image-wise exposure of the electrostatic latent image bearing member for a corresponding color image based on the respective color image information to form an electrostatic latent image corresponding to the respective color image on the electrostatic latent image bearing member; a developing device (not shown) which develops the electrostatic latent image using a respective color toner (black toner, yellow toner, magenta toner, and cyan toner) to form a toner image by the respective color toner; a primary transfer apparatus 62 for transferring the toner image to the intermediate transfer member 10; a cleaning unit (not shown); and a neutralization apparatus (not shown), and an image of a single color (black image, yellow image, magenta image, and cyan image) may be formed based on the respective color image information. Regarding the black image, the yellow image, the magenta image and the cyan image thus formed, the image formed on the photoconductor 40 of the respective colors is sequentially transferred on the intermediate transfer member 10 which is rotated and moved by the support rollers 14, 15 and 16 (primary transfer). Then, the black image, the yellow image, the magenta image and the cyan image are superimposed on intermediate transfer member 10 to form a composite color image (color transfer image).

Meanwhile, in the sheet feeding table 200, one of sheet feeding rollers 42 is selectively rotated to feed recording paper from one of the paper feed cassettes 44 equipped in multiple stages in a paper bank 43. The recording paper is separated one by one by a separation roller 45 and sent to a sheet feeding path 46. Each recording paper is conveyed by a conveying roller 47 and guided to a sheet feeding path 48, and it stops by striking a resist roller 49. Here, the resist roller 49 is generally used while grounded, but it may also be used in a state that a bias is applied for removing paper dust on the recording paper. Next, by rotating the resist roller 49 in accordance with the timing of the composite toner image (color transfer image) formed on the intermediate transfer member 10, the recording paper is fed between intermediate transfer member 10 and a secondary transfer apparatus 22, and the composite color image (color transfer image) is transferred on the recording medium by the secondary transfer apparatus 22 (secondary transfer). Thereby, the color image is transferred and formed on the recording medium. Here, the toner remaining on the intermediate transfer member 10 after transferring the image is cleaned by the intermediate transfer member cleaning apparatus 17.

The recording medium on which the color image is transferred and formed is conveyed by the secondary transfer unit 22 to the fixing unit 25, and in the fixing unit 25, the composite color image (color transfer image) is fixed on the recording medium by heat and pressure. Next, the recording medium is switched by a switching claw 55, discharged by a discharge roller 56 and stacked on a discharge tray 57. Alternatively, it is switched by the switching claw 55, inverted by the inverting apparatus 28 and guided again to the transfer location. After an image is formed similarly on the rear surface of the as well, the recording paper is discharged onto the paper discharge tray 57 by the discharge roller 56. Here, the numerals 26 and 27 in FIG. 1 denote a fixing belt and a pressure roller, respectively.

<Process Cartridge>

A process cartridge used in the present invention includes at least: an electrostatic latent image bearing member; and a developing unit which develops an electrostatic latent image formed on the electrostatic latent image bearing member with a developer to form a visible image, and it further includes other units according to necessity.

The developer is the two-component developer of the present invention.

Figure 2:
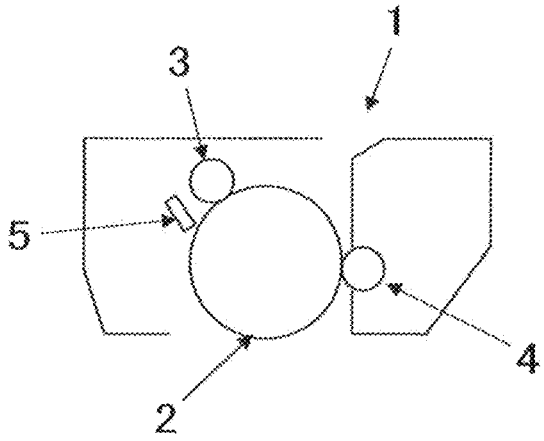
FIG. 2 is a diagram illustrating one example of a process cartridge.
Figure 3:
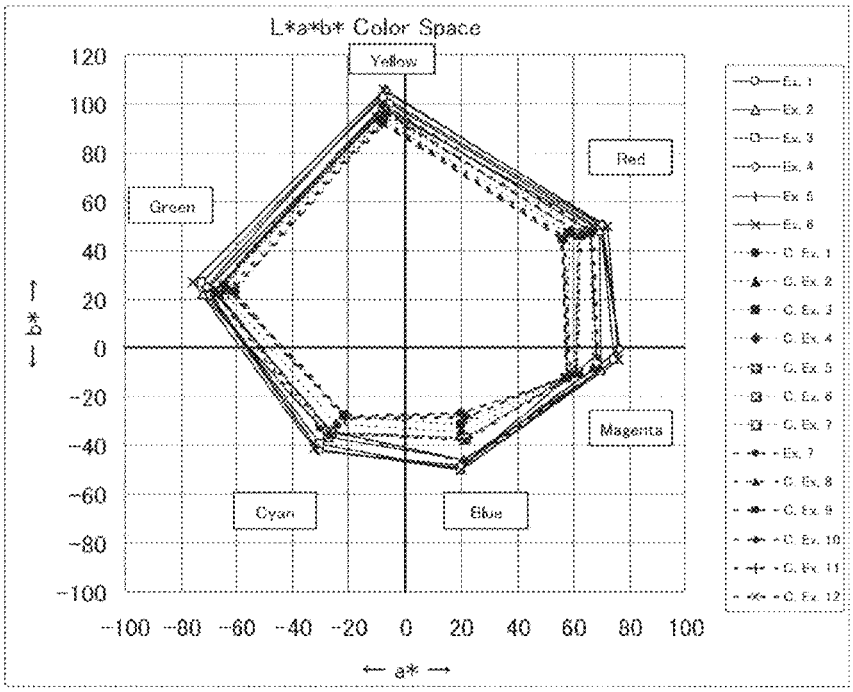
FIG. 3 is a diagram illustrating measurement results of color reproducibility.
Figure 4:
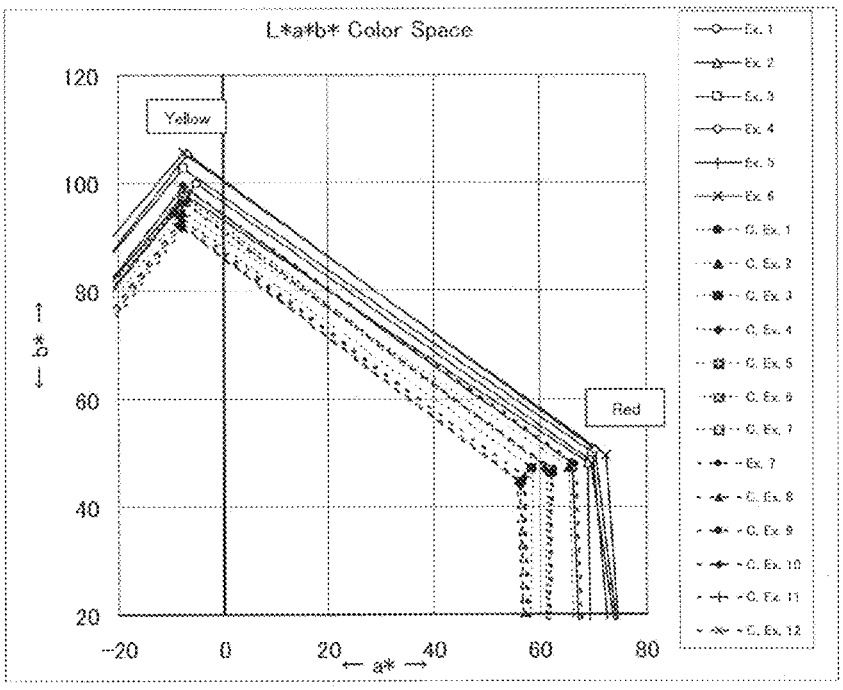
FIG. 4 is an enlarged diagram of FIG. 3 in the vicinity of Yellow and Red.
Figure 5:
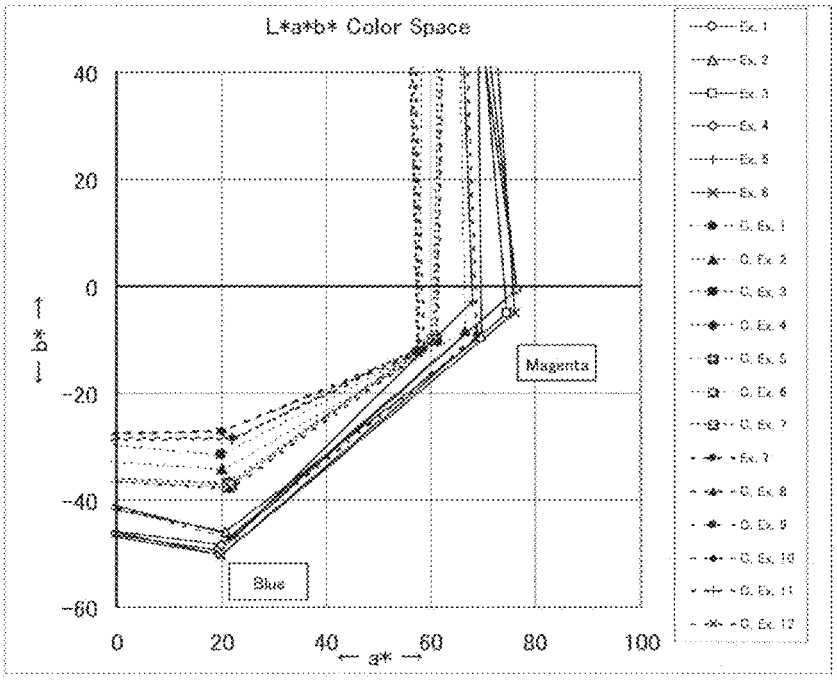
FIG. 5 is an enlarged diagram of FIG. 3 in the vicinity of Magenta and Blue.
Figure 6:
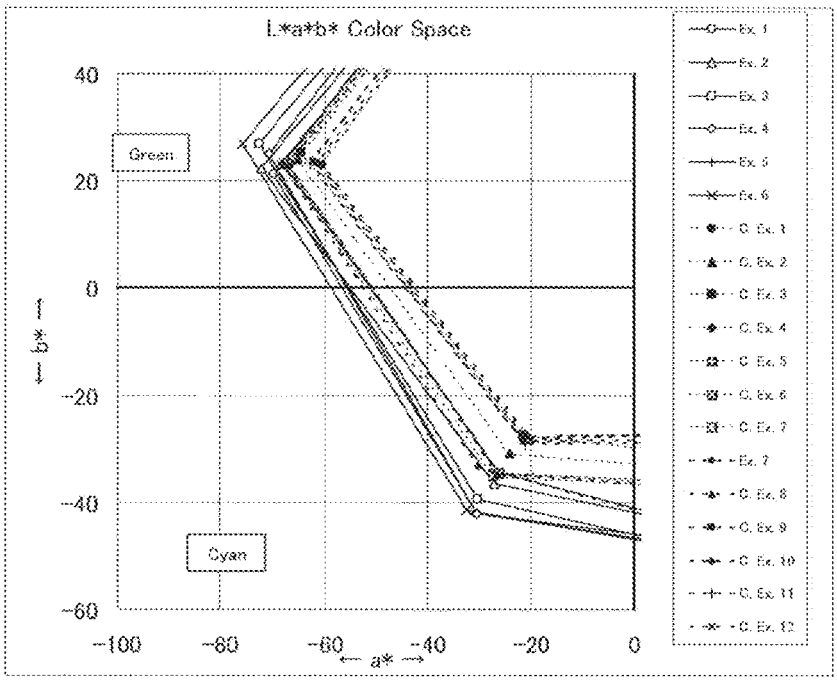
FIG. 6 is an enlarged diagram of FIG. 3 in the vicinity of Green and Cyan.

FIG. 2 is a diagram illustrating one example of the process cartridge.

This process cartridge 1 uses the developer of the present invention. It integrally supports a photoconductor 2, a proximity brush-shaped contact charging unit 3, a developing unit 4 which contains a developer of the present invention, and a cleaning unit which includes at least a cleaning blade 5 as a cleaning device, and it is detachably attached to the image forming apparatus main body. In the present invention, the above-mentioned structural elements are integrally configured as a process cartridge, and an image forming apparatus such as copying machine and printer is configured such that this process cartridge is detachably mounted.

<Toner Accommodating Container>

A toner accommodating container of the present invention includes: the toner or developer of the present invention; and a container which accommodates therein the toner or developer of the present invention.

The container is not particularly limited and may be appropriately selected from known containers. Suitable examples thereof include those having a cap and a toner container main body.

The size, shape, structure and material of the toner container main body are not particularly limited and may be appropriately selected depending on the intended purpose. The toner container main body preferably has, for example, a hollow-cylindrical shape. Particularly preferably, it is a hollow-cylindrical body whose inner surface has spirally-arranged concavo-convex portions part or all of which can accordion and in which a toner accommodated can be transferred to an outlet port through rotation.

The material thereof is not particularly limited and is preferably those from which the toner container main body can be formed with high dimensional accuracy. Among them, preferred are polyester resins, polyethylene resins, polypropylene resins, polystyrene resins, polyvinyl chloride resins, polyacrylic acids, polycarbonate resins, ABS resins and polyacetal resins.

This toner accommodating container has excellent handleability; i.e., is suitable for storage and transportation, and is suitably used for supply of a toner with being detachably mounted to the process cartridge or the image forming apparatus of the present invention.

EXAMPLES

Hereinafter, the present invention is further explained more specifically in reference to Examples and Comparative Examples, but the present invention is not to be construed by these examples. Here, "parts" in the explanation about an amount denotes "parts by mass".

Production of Carrier

Production Example 1

The following materials were dispersed in a homomixer for 10 minutes, and a blended coating layer forming solution including an acrylic resin including alumina particles, and a silicone resin was prepared.

[Composition of Coating Layer Forming Solution]

Acrylic resin solution [solid content of 50% by mass, manufactured by Hitachi Chemical Co., Ltd.] . . . 21.0 parts Guanamine solution [solid content of 70% by mass] . . . 6.4 parts Alumina particles [0.3 μm, specific resistance of $10^{14}$ (Ω·cm)] . . . 7.6 parts Silicone resin solution [solid content 23% by mass, SR2410, manufactured by Dow Corning Toray Co., Ltd.] . . . 65.0 parts Aminosilane [solid content of 100% by mass, SH6020, manufactured by Dow Corning Toray Co., Ltd.] . . . 0.3 parts Toluene . . . 60 parts Butyl cellosolve . . . 60 parts Next, using a baked ferrite powder [$(MgO)_{18}(MnO)_{49.5}(Fe_2O_3)_{48.0}$ as a core material, average particle diameter=35 μm], the coating layer forming solution was coated and dried on a surface of the core material such that a thickness was 0.15 μm by a spira coater (manufactured by Okada Seiko Co, Ltd.).

Next, it was baked by leaving in an electric furnace at 150° C. for 1 hour followed by cooling. The bulk ferrite powder was crushed using a 106-μm mesh sieve, and a carrier was obtained.

Production of Crystalline Binder Resin for Masterbatch A

Production Example 2

In a reactor, 286 parts of dodecanedioic acid, 190 parts of 1,6-hexanediol, and 1 part of titanium dihydroxybis(triethanolaminate) as a condensation catalyst were placed, which was reacted at 180° C. for 8 hours under a stream of nitrogen while distilling generated water. Next, under a stream of nitrogen, it was reacted for 4 hours while gradually heating to 220° C. and distilling generated water, further reacted under a reduced pressure of 5 mmHg to 20 mmHg, and taken out when the weight-average molecular weight (Mw) reached about 10,000. Next, the taken out resin was cooled to a room temperature, followed by pulverization to form particles, and a crystalline polycondensation polyester resin [crystalline portion aa1] was obtained. This [crystalline portion aa1] had a number-average molecular weight (Mn) of 4,900, Mw of 10,000, and a hydroxyl value of 34 mgKOH/g.

In a separate reactor, 38 parts of tolylene diisocyanate and 100 parts of methyl ethyl ketone (MEK) were placed. In this solution, 14 parts of 1,2-propylene glycol were placed and reacted at 80° C. for 2 hours, and an MEK solution of a non-crystalline polyurethane resin having an isocyanate group at an end thereof [non-crystalline portion ab1] was obtained.

Next, 138 parts of this MEK solution of [non-crystalline portion ab1] was added in a solution that 150 parts of [crystalline portion aa1] was dissolved in 150 parts of MEK, which was reacted at 80° C. for 4 hours, and an MEK solution composed of a crystalline portion and a non-crystalline portion [crystalline binder resin A1] was obtained. After removing the solvent, [crystalline binder resin A1] had a melting point of 64° C., Mn of 9,000, and Mw of 34,000.

Production Example 3

In a reactor, 159 parts of sebacic acid, 11 parts of adipic acid, 318 parts of 1,4-butanediol, and 1.5 parts of titanium dihydroxybis(triethanolaminate) as a condensation catalyst were placed, which was reacted at 180° C. for 8 hours under a stream of nitrogen while distilling generated water. Next, under a stream of nitrogen, it was reacted for 4 hours while gradually heating to 225° C. and distilling generated water and 1,4-butanediol, further reacted under a reduced pressure of 5 mmHg to 20 mmHg, and taken out when the weight-average molecular weight (Mw) reached about 10,000. Thereby, a crystalline polyester resin [crystalline portion aa2] was obtained.

In a separate reactor, 44 parts of tolylene diisocyanate, and 100 parts of MEK were placed. In this solution, 32 parts of cyclohexane dimethanol were placed, which was reacted at 80° C. for 2 hours, and an MEK solution of a non-crystalline polyurethane resin [non-crystalline portion ab2] was obtained.

Next, 176 parts of this MEK solution of [non-crystalline portion ab2] was added to a solution that 320 parts of [crystalline portion aa2] was dissolved in 320 parts of MEK, reacted at 80° C. for 4 hours, and an MEK solution of [crystalline binder resin A2] composed of a crystalline portion and a non-crystalline portion. After removing the solvent, [crystalline binder resin A2] had a melting point of 55° C., Mn of 14,000, and Mw of 28,000.

Production Example 4

In a reactor, 159 parts of sebacic acid, 11 parts of adipic acid, 108 parts of 1,4-butanediol, and 0.5 parts of titanium dihydroxybis(triethanolaminate) as a condensation catalyst were placed, which was reacted at 180° C. for 8 hours under a stream of nitrogen while distilling generated water. Next, under a stream of nitrogen, it was reacted for 4 hours while gradually heating to 225° C. and distilling generated water and 1,4-butanediol, further reacted under a reduced pressure of 5 mmHg to 20 mmHg, and taken out when the weight-average molecular weight (Mw) reached about 10,000. Thereby, a crystalline polyester resin [crystalline portion aa3] was obtained.

In a separate reactor, 50 parts of tolylene diisocyanate, and 100 parts of MEK were placed. In this solution, 46 parts of cyclohexane dimethanol was placed and reacted at 80° C. for 2 hours, and an MEK solution of a non-crystalline polyurethane resin [non-crystalline portion ab3] was obtained.

Next, 196 parts of this MEK solution of [non-crystalline portion ab3] was added to a solution that 110 parts of [crystalline portion aa3] were dissolved in 140 parts of MEK, reacted at 80° C. for 4 hours, and an MEK solution of [crystalline binder resin A3] composed of a crystalline portion and a non-crystalline portion was obtained. After removing the solvent, [crystalline binder resin A3] had a melting point of 58° C., Mn of 15,000, and Mw of 30,000.

Production Example 5

In a reactor, 159 parts of sebacic acid, 28 parts of adipic acid, 124 parts of 1,4-butanediol, and 1 part of titanium dihydroxybis(triethanolaminate) as a condensation catalyst were placed, which was reacted at 180° C. for 8 hours under a stream of nitrogen while distilling generated water. Next, under a stream of nitrogen, it was reacted for 2 hours while gradually heating to 210° C. and distilling generated water and 1,4-butanediol, further reacted under a reduced pressure of 5 mmHg to 20 mmHg, and taken out when the weight-average molecular weight (Mw) reached about 5,000. Next, the taken out resin was cooled to a room temperature, followed by pulverization to form particles, and a crystalline polycondensation polyester resin [crystalline portion aa4] was obtained. This [crystalline portion aa4] had a melting point of 55° C., Mn of 2,300, Mw of 5,000, hydroxyl value of 83 mgKOH/g.

In a separate reactor, 44 parts of tolylene diisocyanate, and 100 parts of MEK were placed. In this solution, 32 parts of cyclohexane dimethanol were added and reacted at 80° C. for 2 hours, and an MEK solution of a non-crystalline polyurethane resin having an isocyanate group at an end thereof [non-crystalline portion ab4] was obtained.

Next, 176 parts of this MEK solution of [non-crystalline portion ab4] was added in a solution that 110 parts of [crystalline portion aa4] were dissolved in 110 parts of MEK, reacted at 80° C. for 4 hours, and an MEK solution composed of a crystalline portion and a non-crystalline portion [crystalline binder resin A4] was obtained. After removing the solvent, [crystalline binder resin A4] had a melting point of 54° C., Mn of 9,000, and Mw of 20,000.

Production Example 6

In a 1-L autoclave, 540 parts of (S)-propylene oxide and 90 parts of KOH were placed, which was stirred at a room temperature for 48 hours for polymerization. An obtained polymer was melted by heating it to 70° C., and an operation that 300 parts of toluene and 300 parts of water were added and followed by liquid separation was repeated for 3 times in order to wash KOH. The toluene phase was neutralized with hydrochloric acid of 0.1 mol/L. Liquid separation was further carried out three times by adding 300 parts of water for each separation, and toluene was distilled from the toluene phase. An obtained resin was cooled to a room temperature, followed by pulverization to form particles, and a crystalline polyether resin [crystalline portion aa5] was obtained. This [crystalline portion aa5] had a Mw of 9,000, a hydroxyl value of 20 mgKOH/g, and an isotacticity of 99%.

In a separate reactor, 44 parts of tolylene diisocyanate, and 100 parts of MEK were place. In this solution, 32 parts of cyclohexane dimethanol were placed, which was reacted at 80° C. for 2 hours, and an MEK solution of a non-crystalline polyurethane resin [non-crystalline portion ab5] was obtained.

Next, 176 parts of this MEK solution of [non-crystalline portion ab5] was added to a solution that 500 parts of [crystalline portion aa5] was dissolved in 250 parts of MEK, reacted at 80° C. for 4 hours, and an MEK solution composed of a crystalline portion and a non-crystalline portion [crystalline binder resin A5] was obtained. After removing the solvent, [crystalline binder resin A5] had a melting point of 64° C., Mn of 9,000, and Mw of 13,000.

Production Example 7

In a reactor, 500 parts of dodecanedioic acid, 350 parts of 1,6-hexanediol, and 1 part of titanium dihydroxybis(triethanolaminate) as a condensation catalyst were placed, which was reacted at 180° C. for 8 hours under a stream of nitrogen while distilling generated water. Next, under a stream of nitrogen, it was reacted for 4 hours while gradually heating to 220° C. and distilling generated water, further reacted at a reduced pressure of 5 mmHg to 20 mmHg, and taken out when the weight-average molecular weight (Mw) reached about 10,000. Next, the taken out resin was cooled to a room temperature, followed by pulverization to form particles, and crystalline polycondensation polyester resin [crystalline portion aa6] was obtained. This [crystalline portion aa6] had a number-average molecular weight (Mn) of 4,900, Mw of 10,000, and an hydroxyl value of 34 mgKOH/g.

In a separate reactor, 38 parts of tolylene diisocyanate, and 100 parts of MEK were placed. In this solution, 300 parts of [crystalline portion aa6] dissolved in 300 parts of MEK was added, which was reacted at 80° C. for 4 hours, and an MEK solution composed only of a crystalline portion [crystalline binder resin A6] was obtained. After removing the solvent, [crystalline binder resin A6] had a melting point of 62° C., Mn of 8,800, and Mw of 30,000.

Production Example 8

To a reaction vessel equipped with a cooling tube, a stirrer, and a nitrogen inlet tube, 123 parts of 1,4-butanediamine, 211 parts of 1,6-hexanediamine, and 100 parts of MEK were placed and stirred, and 341 parts of hexamethylene diisocyanate were added, which was reacted at 60° C. for 5 hours under a stream of nitrogen. Next, MEK was distilled at a reduced pressure, and [crystalline binder resin A7] (crystalline polyurea resin) having Mw of about 22,000 and a melting point of 63° C. was obtained.

Production Example 9

To a reaction vessel equipped with a cooling tube, a stirrer, and a nitrogen inlet tube, 185 parts of sebacic acid (0.91 moles), 13 parts of adipic acid (0.09 moles), 125 parts of 1,4-butanediol (1.39 moles), and 0.5 parts of titanium dihydroxybis(triethanolaminate) as a condensation catalyst were placed, which was reacted at 180° C. for 8 hours under a stream of nitrogen while distilling generated water. Next, it was reacted for 4 hours under a stream of nitrogen while gradually heating to 220° C. and distilling generated water and 1,4-butanediol, further reacted at a reduced pressure of 5 mmHg to 20 mmHg until Mw reached about 10,000. Thereby, [crystalline binder resin A8] was obtained. The obtained [crystalline binder resin A8] had Mw of 9,500 and a melting point of 57° C.

Production of Non-Crystalline Binder Resin for Masterbatch D

Production Example 10

In a reactor, 456 parts of bisphenol A •PO 2-mole adduct (9.0 moles), 321 parts of bisphenol A •EO 2-mole adduct (7.0 moles), 247 parts of terephthalic acid (10.0 moles), and 3 parts of tetrabutoxytitanate were placed, which was reacted at 230° C. for 5 hours under a stream of nitrogen while distilling generated water. Next, it was reacted at a reduced pressure of 5 mmHg to 20 mmHg and cooled to 180° C. when the acid value became 2 mgKOH/g. Then, 74 parts of trimellitic anhydride (2.6 moles) were added. It was reacted for 2 hours at a normal pressure under a closed condition, and taken out. Thereby, a non-crystalline resin [non-crystalline portion dd] was obtained. This [non-crystalline portion dd] had a melting point of 55° C., and Mw of 7,500.

In a separate reactor, 44 parts of tolylene diisocyanate, and 100 parts of MEK were placed. In this solution, 32 parts of 1,2-propylene glycol was placed, which was reacted at 80° C. for 2 hours, and an MEK solution of a non-crystalline polyurethane resin having an isocyanate group at an end thereof [non-crystalline portion de] was obtained.

Next, 176 parts of this MEK solution of [non-crystalline portion de] was added to a solution that 200 parts of [non-crystalline portion dd] was dissolved in 260 parts of MEK, which was reacted at 80° C. for 4 hours, and an MEK solution composed only of a non-crystalline portion [non-crystalline binder resin D] was obtained. After removing the solvent, [non-crystalline binder resin D] had a melting point of 64° C., Mn of 14,000, and Mw of 28,000.

Production of Crystalline Binder Resin B

Production Example 11

In a reactor, 240 parts of sebacic acid, 17 parts of adipic acid, 162 parts of 1,4-butanediol, and 0.8 parts of titanium dihydroxybis(triethanolaminate) as a condensation catalyst were placed, which was reacted at 180° C. for 8 hours under a stream of nitrogen while distilling generated water. Next, it was reacted for 4 hours under a stream of nitrogen while gradually heating to 225° C. and distilling generated water and 1,4-butanediol, further reacted at a reduced pressure of 5 mmHg to 20 mmHg, and taken out when Mw reached about 10,000. Thereby, a crystalline polyester resin [crystalline portion ba1] was obtained.

In a separate reactor, 44 parts of tolylene diisocyanate, and 100 parts of MEK were placed. In this solution, 32 parts of cyclohexane dimethanol were placed, which was reacted at 80° C. for 2 hours, and an MEK solution of a non-crystalline polyurethane resin [non-crystalline portion bb1] was obtained.

Next, 176 parts of this MEK solution of [non-crystalline portion bb1] was added to a solution that 320 parts of [crystalline portion ba1] was dissolved in 320 parts of MEK, which was reacted at 80° C. for 4 hours, and an MEK solution composed of a crystalline portion and a non-crystalline portion [crystalline binder resin B1] was obtained. After removing the solvent, [crystalline binder resin B1] had a melting point of 55° C., Mn of 14,000, and Mw of 20,000.

Production Example 12

In a reactor, 159 parts of sebacic acid, 28 parts of adipic acid, 124 parts of 1,4-butanediol, and 1 part of titanium dihydroxybis(triethanolaminate) as a condensation catalyst were placed, which was reacted at 180° C. for 8 hours under a stream of nitrogen while distilling generated water. Next, under a stream of nitrogen, it was reacted for 2 hours while gradually heating to 210° C. and distilling generated and 1,4-butanediol, further reacted at a reduced pressure of 5 mmHg to 20 mmHg, and taken out when Mw reached about 5,000. Next, the take out resin was cooled to a room temperature, followed by pulverization to form particles, and a crystalline polycondensation polyester resin [crystalline portion bat] was obtained. This [crystalline portion bat] had a melting point of 55° C., Mn of 2,300, Mw of 5,000, and a hydroxyl value of 83 mgKOH/g.

In a separate reactor 44 parts of tolylene diisocyanate, and 100 parts of MEK were placed. In this solution, 32 parts of cyclohexane dimethanol was placed, which was reacted at 80° C. for 2 hours, and an MEK solution of a non-crystalline polyurethane resin having an isocyanate group at an end thereof [non-crystalline portion bb2] was obtained.

Next, 176 parts of this MEK solution of [non-crystalline portion bb2] was added to a solution that 110 parts of [crystalline portion ba2] was dissolved in 110 parts of MEK, which was reacted at 80° C. for 4 hours, and an MEK solution composed of a crystalline portion and a non-crystalline portion [crystalline binder resin B2] was obtained. After removing the solvent, [crystalline binder resin B2] had a melting point of 52° C., Mn of 6,000, and Mw of 13,000.

Production Example 13

In a reactor, 500 parts of dodecanedioic acid, 350 parts of 1,6-hexanediol, and 1 part of titanium dihydroxybis(triethanolaminate) as a condensation catalyst were placed, which was reacted at 180° C. for 8 hours under a stream of nitrogen while distilling generated water. Next, under a stream of nitrogen, it was reacted for 4 hours while gradually heating to 220° C. and distilling generated water, further reacted at a reduced pressure of 5 mmHg to 20 mmHg, and taken out when the weight-average molecular weight (Mw) reached about 10,000. Next, the taken out resin was cooled to a room temperature, followed by pulverization to form particles, and a crystalline polycondensation polyester resin [crystalline portion ba3] was obtained. This [crystalline portion ba3] had a number-average molecular weight (Mn) of 4,900, Mw of 10,000, and a hydroxyl value of 34 mgKOH/g.

In a separate reactor, 38 parts of tolylene diisocyanate, and 100 parts of MEK were placed. In this solution, 300 parts of [crystalline portion ba3] dissolved in 300 parts of MEK were added, which was reacted at 80° C. for 4 hours, and an MEK solution of [crystalline binder resin B3] composed only of crystalline portion was obtained. After removing the solvent, [crystalline binder resin B3] had a melting point of 62° C., Mn of 8,800, and Mw of 30,000.

Production Example 14

To a reaction vessel equipped with a cooling tube, a stirrer, and a nitrogen inlet tube, 123 parts of 1,4-butanediamine, 211 parts of 1,6-hexanediamine, and 100 parts of MEK were placed and stirred, and 341 parts of hexamethylene diisocyanate were added, which was reacted at 60° C. for 5 hours under a stream of nitrogen. Next, MEK was distill at a reduced pressure, and [crystalline binder resin B4] (crystalline polyurea resin) having Mw of about 22,000 and a melting point of 63° C. was obtained.

Production Example 15

A crystalline polyester resin [crystalline portion ba1] was obtained in the same manner as Production Example 11.

In a separate reactor, 30 parts of tolylene diisocyanate, and 100 parts of MEK were placed. In this solution, 22 parts of cyclohexane dimethanol was placed, which was reacted at 80° C. for 2 hours, and an MEK solution of a non-crystalline polyurethane resin [non-crystalline portion bb3] was obtained.

Next, 176 parts of this MEK solution of [non-crystalline portion bb3] was added to a solution that 320 parts of [crystalline portion ba1] was dissolved in 320 parts of MEK, which was reacted at 80° C. for 4 hours, and an MEK solution composed of a crystalline portion and a non-crystalline portion [crystalline binder resin B5] was obtained. After removing the solvent, [crystalline binder resin B5] had a melting point of 50° C., Mn of 12,000, and Mw of 18,000.

Production Example 16

To a reaction vessel equipped with a cooling tube, a stirrer, and a nitrogen inlet tube, 185 parts of sebacic acid (0.91 moles), 13 parts of adipic acid (0.09 moles), 125 parts of 1,4-butanediol (1.39 moles), and 0.5 parts of titanium dihydroxybis(triethanolaminate) as a condensation catalyst were placed, which was reacted at 180° C. for 8 hours under a stream of nitrogen while distilling generated water. Next, it was reacted for 4 hours under a stream of nitrogen while gradually heating to 220° C. and distilling generated water and 1,4-butanediol, further reacted at a reduced pressure of 5 mmHg to 20 mmHg until Mw reached about 10,000. Thereby, [crystalline binder resin B6] was obtained. The obtained [crystalline binder resin B6] had Mw of 9,500 and a melting point of 57° C.

Production of Non-Crystalline Binder Resin E

Production Example 17

In a reactor, 456 parts of bisphenol A •PO (propylene oxide) 2-mole adduct (9.0 moles), 321 parts of bisphenol A •EO (ethylene oxide) 2-mole adduct (7.0 moles), 247 parts of terephthalic acid (10.0 moles), and 3 parts of tetrabutoxytitanate were placed, which was reacted at 230° C. for 5 hours under a stream of nitrogen while distilling generated water. Next, it was reacted at a reduced pressure of 5 mmHg to 20 mmHg and cooled to 180° C. when the acid value became 2. Then, 74 parts of trimellitic anhydride (2.6 moles) was added. It was reacted for 2 hours at a normal pressure under a closed condition, and taken out. Thereby, a non-crystalline resin [non-crystalline portion ed] was obtained. This [non-crystalline portion ed] had a melting point of 55° C., and Mw of 7,500.

In a separate reactor, 38 parts of tolylene diisocyanate, and 100 parts of MEK were placed. In this solution, 14 parts of 1,2-propylene glycol were placed, which was reacted at 80° C. for 2 hours, and an MEK solution of a non-crystalline polyurethane resin having an isocyanate group at an end thereof [non-crystalline portion ee] was obtained.

Next, 152 parts of this MEK solution of [non-crystalline portion ee] was added in a solution that 250 parts of [non-crystalline portion ed] were dissolved in 250 parts of MEK, which was reacted at 80° C. for 4 hours, and an MEK solution of [non-crystalline binder resin E] composed only of a non-crystalline portion was obtained. After removing the solvent, [non-crystalline binder resin E] had a melting point of 64° C., Mn of 9,000, and Mw of 28,000.

<Concentration of Urethane-Urea Groups>

A concentrations of urethane-urea groups of thus-produced crystalline binder resin A, crystalline binder resin B, non-crystalline binder resin D, and non-crystalline binder resin E for a masterbatch was calculated from the following formula based on the charged amount of resin synthesis. The results are shown in Table 1.

Concentration of urethane-urea groups (% by mass)= [unit mass calculated from amount of isocyanate used for synthesis/charged amount of resin raw material excluding solvent (mass)]×100

Preparation of Masterbatch

Production Example 18

A toner material composed of 25 parts of water, 50 parts of yellow pigment (Pigment Yellow 155), and 50 parts of [crystalline binder resin A1] was mixed using a HENSCHEL mixer (HENSCHEL 20B, manufactured by Mitsui Mining Co., Ltd.) at 1,500 rpm for 3 minutes and then kneaded using a twin roll at 120° C. for 45 minutes. It was rolled and cooled, followed by pulverization by a pulverizer, and [masterbatch Y1] was obtained.

[Masterbatch Y2] to [masterbatch Y8] were obtained in the same manner as above except that [crystalline binder resin A1] was replaced by [crystalline binder resin A2] to [crystalline binder resin A7] and [non-crystalline binder resin D].

Production Example 19

A toner material composed of 25 parts of water, 50 parts of magenta pigment (Pigment Red 269), and 50 parts of [crystalline binder resin A1] was mixed using a HENSCHEL mixer (HENSCHEL 20B, manufactured by Mitsui Mining Co., Ltd.) at 1,500 rpm for 3 minutes and then kneaded using a twin roll at 120° C. for 45 minutes. It was rolled and cooled, followed by pulverization by a pulverizer, and [masterbatch M1] was obtained.

[Masterbatch M2] to [masterbatch M8] were obtained in the same manner as above except that [crystalline binder resin A1] was replaced by [crystalline binder resin A2] to [crystalline binder resin A7] and [non-crystalline binder resin D].

Production Example 20

A toner material composed of 25 parts of water, 50 parts of cyan pigment (Pigment Blue 15:3), and 50 parts of [crystalline binder resin A1] was mixed using a HENSCHEL mixer (HENSCHEL 20B, manufactured by Mitsui Mining Co., Ltd.) at 1,500 rpm for 3 minutes and then kneaded using a twin roll at 120° C. for 45 minutes. It was rolled and cooled, followed by pulverization by a pulverizer, and [masterbatch C1] was obtained.

[Masterbatch C2] to [masterbatch C8] were obtained in the same manner as above except that [crystalline binder resin A1] was replaced by [crystalline binder resin A2] to [crystalline binder resin A7] and [non-crystalline binder resin D].

Preparation of Toner

Example 1

In 110 parts of ethyl acetate, 93 parts of [crystalline binder resin B1], 14 parts of [masterbatch Y1], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 1Y] was obtained.

[Toner 1M] was obtained in the same manner as above except that [masterbatch Y1] was changed to [masterbatch M1].

[Toner 1C] was obtained in the same manner as above except that [masterbatch Y1] was changed to [masterbatch C1].

Example 2

In 110 parts of ethyl acetate, 93 parts of [crystalline binder resin B1], 14 parts of [masterbatch Y2], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 2Y] was obtained.

[Toner 2M] was obtained in the same manner as above except that [masterbatch Y2] was changed to [masterbatch M2].

[Toner 2C] was obtained in the same manner as above except that [masterbatch Y2] was changed to [masterbatch C2].

Example 3

In 110 parts of ethyl acetate, 93 parts of [crystalline binder resin B2], 14 parts of [masterbatch Y3], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 3Y] was obtained.

[Toner 3M] was obtained in the same manner as above except that [masterbatch Y3] was changed to [masterbatch M3].

[Toner 3C] was obtained in the same manner as above except that [masterbatch Y3] was changed to [masterbatch C3].

Example 4

In 110 parts of ethyl acetate, 93 parts of [crystalline binder resin B2], 14 parts of [masterbatch Y4], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 4Y] was obtained.

[Toner 4M] was obtained in the same manner as above except that [masterbatch Y4] was changed to [masterbatch M4].

[Toner 4C] was obtained in the same manner as above except that [masterbatch Y4] was changed to [masterbatch C4].

Example 5

In 110 parts of ethyl acetate, 93 parts of [crystalline binder resin B3], 14 parts of [masterbatch Y6], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 5Y] was obtained.

[Toner 5M] was obtained in the same manner as above except that [masterbatch Y6] was changed to [masterbatch M6].

[Toner 5C] was obtained in the same manner as above except that [masterbatch Y6] was changed to [masterbatch C6].

Example 6

In 110 parts of ethyl acetate, 93 parts of [crystalline binder resin B4], 14 parts of [masterbatch Y7], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 6Y] was obtained.

[Toner 6M] was obtained in the same manner as above except that [masterbatch Y7] was changed to [masterbatch M7].

[Toner 6C] was obtained in the same manner as above except that [masterbatch Y7] was changed to [masterbatch C7].

Example 7

In 110 parts of ethyl acetate, 70 parts of [crystalline binder resin B2], 23 parts of [non-crystalline binder resin E], 14 parts of [masterbatch Y3], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMDCER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 7Y] was obtained.

[Toner 7M] was obtained in the same manner as above except that [masterbatch Y3] was changed to [masterbatch M3], and [Toner 7C] was obtained in the same manner as above except that [masterbatch Y3] was changed to [masterbatch C3].

Comparative Example 1

In 110 parts of ethyl acetate, 93 parts of [crystalline binder resin B1], 14 parts of [masterbatch Y5], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMDCER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 8Y] was obtained.

[Toner 8M] was obtained in the same manner as above except that [masterbatch Y5] was changed to [masterbatch M5].

[Toner 8C] was obtained in the same manner as above except that [masterbatch Y5] was changed to [masterbatch C5].

Comparative Example 2

In 110 parts of ethyl acetate, 100 parts of [crystalline binder resin B1], 7 parts of yellow pigment (Pigment Yellow 155), 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMDCER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 9Y] was obtained.

[Toner 9M] was obtained in the same manner as above except that the yellow pigment was changed to a magenta pigment (Pigment Red 269).

[Toner 9C] was obtained in the same manner as above except that the yellow pigment was changed to a cyan pigment (Pigment Blue 15:3).

Comparative Example 3

In 110 parts of ethyl acetate, 93 parts of [non-crystalline binder resin E], 14 parts of [masterbatch Y8], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 10Y] was obtained.

[Toner 10M] was obtained in the same manner as above except that [masterbatch Y8] was changed to [masterbatch M8].

[Toner 10C] was obtained in the same manner as above except that [masterbatch Y8] was changed to [masterbatch C8].

Comparative Example 4

In 110 parts of ethyl acetate, 93 parts of [crystalline binder resin B5], 14 parts of [masterbatch Y5], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 11Y] was obtained.

[Toner 11M] was obtained in the same manner as above except that [masterbatch Y5] was changed to [masterbatch M5].

[Toner 11C] was obtained in the same manner as above except that [masterbatch Y5] was changed to [masterbatch C5].

Comparative Example 5

In 110 parts of ethyl acetate, 93 parts of [crystalline binder resin B6], 14 parts of [masterbatch Y8], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 12Y] was obtained.

[Toner 12M] was obtained in the same manner as above except that [masterbatch Y8] was changed to [masterbatch M8].

[Toner 12C] was obtained in the same manner as above except that [masterbatch Y8] was changed to [masterbatch C8].

Comparative Example 6

In 110 parts of ethyl acetate, 93 parts of [crystalline binder resin B5], 14 parts of [masterbatch Y2], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-am mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 13Y] was obtained.

[Toner 13M] was obtained in the same manner as above except that [masterbatch Y2] was changed to [masterbatch M2].

[Toner 13C] was obtained in the same manner as above except that [masterbatch Y2] was changed to [masterbatch C2].

Comparative Example 7

In 110 parts of ethyl acetate, 93 parts of [crystalline binder resin B5], 14 parts of [masterbatch Y1], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 14Y] was obtained.

[Toner 14M] was obtained in the same manner as above except that [masterbatch Y1] was changed to [masterbatch C1].

[Toner 14C] was obtained in the same manner as above except that [masterbatch Y1] was changed to [masterbatch C1].

Comparative Example 8

In 110 parts of ethyl acetate, 93 parts of [crystalline binder resin B2], 14 parts of [masterbatch Y2], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMDCER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75 μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 15Y] was obtained

[Toner 15M] was obtained in the same manner as above except that [masterbatch Y2] was changed to [masterbatch M2], and [Toner 15C] was obtained in the same manner as above except that [masterbatch Y2] was changed to [masterbatch C2].

Comparative Example 9

In 110 parts of ethyl acetate, 93 parts of [crystalline binder resin B2], 14 parts of [masterbatch Y8], 1 part of a negatively charged charge controlling agent "BONTRON E-304" (manufactured by Orient Chemical Industries Co., Ltd.), and 1 part of polypropylene wax "NP-105" (manufactured by Mitsui Chemicals Inc.) were dissolved and dispersed using a bead mill (ULTRA VISCO MILL, manufactured by Aimex Co., Ltd.), and a resin solution was obtained.

This resin solution was added to a mixed solution of 200 parts of water, 4 parts of sodium dodecylbenzene sulfonate (MON-7, manufactured by Sanyo Chemical Industries, Ltd.), and 20 parts of ethyl acetate, which was mixed using a TK HOMOMIXER (manufactured by Primix Corporation) at 13,000 rpm for 2 minutes, and an aqueous medium dispersion was obtained.

Next, after leaving at 30° C. for 8 hours for desolvation, an operation of dispersion in water and washing by filtration was repeated 3 times to wash particle surfaces, followed by filtration and drying at 45° C. for 48 hours, and toner base was obtained by passing through a sieve of 75-μm mesh.

To 100 parts of this toner base, 1.0 part of "AEROSIL R-972" (manufactured by Nippon Aerosil Co., Ltd.) was added as an external additive, which was mixed with a HENSCHEL mixer, and [toner 16Y] was obtained.

[Toner 16M] was obtained in the same manner as above except that [masterbatch Y8] was changed to [masterbatch M8].

[Toner 16C] was obtained in the same manner as above except that [masterbatch Y8] was changed to [masterbatch C8].

Comparative Example 10

[Toner 17Y], [Toner 17M], and [Toner 17C] were obtained in the same manner as in Comparative Example 9 except that [non-crystalline binder resin B1] was changed to [non-crystalline binder resin B2].

Comparative Example 11

[Toner 18Y], [Toner 18M], and [Toner 18C] were obtained in the same manner as in Comparative Example 9 except that [non-crystalline binder resin B1] was changed to [non-crystalline binder resin B3].

Comparative Example 12

[Toner 19Y], [Toner 19M], and [Toner 19C] were obtained in the same manner as in Comparative Example 9 except that [non-crystalline binder resin B1] was changed to [non-crystalline binder resin B4].

For each toner of the Example and Comparative Example, a number-average particle diameter, a ratio of particles having a particle diameter of 0.7 μm or greater, and [Cr/(Cr+Am)] were measured or calculated as follows.

<Number-Average Particle Diameter of Pigment in Toner>

A number-average particle diameter and a particle size distribution of a pigment in a toner were measured as follows.

The toner was embedded in an epoxy resin, and a measurement sample was prepared by subjecting it to ultrathin sectioning using MICROTOME MT6000-XL (manufactured by Meiwafosis Co., Ltd.) to about 100 nm. Next, using an electron microscope (H-9000NAR, manufactured by Hitachi, Ltd.), TEM pictures of several samples were taken with an accelerating voltage of 100 kV and at a magnification of 10,000 to 40,000. The image information was converted to image data by an image processing and analysis apparatus LUZEX III of IMAGE ANALYZER. For target pigment particles, measurements were repeated by sampling at random exceeding 300 particles having a particle diameter of 0.1 μm or greater, and a number-average particle diameter and a particle size (particle diameter) distribution were obtained.

<Ratio of Particles Having Particle Diameter of 0.7 μm or Greater>

From the results obtained by the measurement of the number-average particle diameter and the particle size distribution, a ratio of particles having a particle diameter of 0.7 μm or greater was calculated.

<Ratio[$Cr/(Cr+Am)$]>

The ratio [Cr/(Cr+Am)] indicates an amount of a crystallization region in a toner (mainly an amount of a crystallization region in a binder resin as a main component of the toner). The x-ray diffraction measurement may be carried out using an x-ray diffractometer equipped with a 2-dimensional detector (D8 DISCOVER with GADDS manufactured by Broker).

For the measurement, a mark tube (Lindemann glass) having a diameter of 0.70 mm was used as a capillary. The sample was filled to an upper portion of this capillary tube for measurement. Also, it was tapped when the sample was filled, where the number of tapping was 100.

Detailed measurement conditions are described below.

Tube current: 40 mA
Tube voltage: 40 kV
Goniometer 2θ axis: 20.0000°
Goniometer Ω axis: 0.0000°
Goniometer ϕ axis: 0.0000°
Detector distance: 15 cm (wide-angle measurement)
Measurement range: 3.2≤2θ(°)≤37.2
Measurement time: 600 sec.

A collimator having pinhole with a diameter of 1 mm was used for an incident optical system. Obtained 2-dimensional data were integrated with a supplied software (at 3.2° to 37.2° in the x-axis) and converted to 1-dimensional data of a diffraction intensity and 2θ. Based on the obtained x-ray diffraction measurement results, a method for calculating the ratio [Cr/(Cr+Am)] is explained below.

Examples of diffraction spectra obtained by an x-ray diffraction measurement are illustrated in FIG. 7 and FIG. 8. The horizontal axis represents 2θ (°), represents the x-ray diffraction intensity, and the both are linear axes. In the x-ray diffraction spectrum in FIG. 7, there are main peaks (P1, P2) at 2θ=21.3° and 24.2°, halos (h) are observed in a wide range including these two peaks. Here, the main peaks are derived from the crystalline structure while the halos are derived from the non-crystalline structure.

As shown by [Formula A1], [Formula A2], and [Formula A3] below, these two main peaks and halos are expressed by Gaussian functions fp1(2θ), fp2(2θ), fh(2θ). A sum of these three functions f(2θ) expressed by [Formula A4] below was regarded as a fitting function of the overall x-ray diffraction spectrum (see FIG. 8), and a fitting was carried out by a least squared method.

$$fp1(2\theta)=ap1\exp\{-(2\theta-bp1)2/(2cp1)2\} \quad \text{Formula A1}$$

$$fp2(2\theta)=ap2\exp\{-(2\theta-bp2)2/(2cp2)2\} \quad \text{Formula A2}$$

$$fh(2\theta)=ah\exp\{-(2\theta-bh)2/(2ch)2\} \quad \text{Formula A3}$$

$$f(2\theta)=fp1(2\theta)+fp2(2\theta)+fh(2\theta) \quad \text{Formula A4}$$

There were 9 fitting variables, namely ap1, bp1, cp1, ap2, bp2, cp2, ah, bh and ch. As initial values of these variables for fitting, peak locations of the x-ray diffraction were set for by 1, bp2 and bh (in the example of FIG. 7, bp1=21.3, bp2=24.2, and bh=22.5), and appropriate values were input for the other variables so that the two main peaks and halos coincided as much as possible with the x-ray diffraction spectrum. The fitting was carried out using a solver of Excel 2003, manufactured by Microsoft Corporation.

From the integrated areas (Sp1, Sp2, Sh) of fp1(2θ), fp2(2θ) and fh(2θ), respectively, after fitting were obtained, and the ratio [Cr/(Cr+Am)] as an indicator of an amount of the crystallization region was calculated, assuming (Sp1+Sp2) was (Cr) and Sh was (Am).

<Preparation of Two-Component Developer>

By stirring 5 parts of the respective toners above and 95 parts of the carrier of Production Example 1 by a TURBULA mixer (T2F, manufactured by Willy A. Bachofen AG Maschinenfabrik), and two-component developers were prepared.

For each of the two-component developer above, various properties were evaluated as follows. The results are summarized and shown in Table 1. Here, in each of Examples and Comparative Examples, evaluation results of low-temperature fixing property and storage stability were almost identical even though toner Y, toner M and toner C were replaced.

<Low-Temperature Fixing Property>

A digital full-color printer (IMAGIO MP C-5000, manufactured by Ricoh Company, Ltd.) having a basic structure illustrated in FIG. 1, was modified so that a temperature setting of a fixing apparatus may be changed.

To this, paper TYPE 6200, manufactured by Ricoh Company, Ltd. was set, and solid images were output in a monochromatic mode using magenta developers of respective Examples and Comparative Examples. Each image obtained at each fixing temperature was adhered to a "UNICEF CELLOPHANE" (manufactured by Mitsubishi Pencil Co., Ltd.; width: 18 mm; JIS Z-1522). After passing through fixing rollers of the fixing apparatus whose temperature was set at 30° C., the tape was peeled off. Optical reflection density values before and after the tape peeling were measured using a reflection densitometer "RD-915" (manufactured by Macbeth Process Measurements Co.). A temperature of the fixing rollers at which a ratio thereof (after peeling/before peeling) exceeds 95% first was regarded as a minimum fixing temperature, and low-temperature fixing property was evaluated according to the following evaluation criteria

[Evaluation Criteria]

A: Minimum fixing temperature was less than 130° C.

B: Minimum fixing temperature was 130° C. or greater and less than 160° C.

C: Minimum fixing temperature was 160° C. or greater.

<Storage Stability>

In a cylindrical container having a diameter of 5 cm and a height of 2 cm, 4 g of each toner was placed, which was left standing in an environment having a temperature of 45° C. and a relative humidity of 65% for 72 hours. After standing, the container with the toner was shaken lightly, and presence of absence of occurrence of agglomeration of the toner was visually observed. Storage stability of the toner was evaluated based on the following evaluation criteria.

[Evaluation Criteria]

A: 1 to 2 agglomerates of the toner were observed.

B: 3 to 5 agglomerates of the toner were observed.

C: 6 or more agglomerates of the toner was observed.

<Color Reproducibility>

A two-component developer using the color toners of the three colors shown in the columns of Example and Comparative Example in Table 1 was set in the modified digital full-color printer (IMAGIO MP C-5000, manufactured by Ricoh Company, Ltd.). After 300,000 sheets of an image chart having an image area of 50% was output in a repeated running in a monochromatic mode, a solid image of each color including a secondary color was output on TYPE 6000 paper manufactured by Ricoh Company, Ltd. 6000. L*a*b* was measured by X-Rite (manufactured by X-Rite), and color reproducibility was compared.

The results are shown in FIGS. 3 to 6 and Tables A to C, and a larger range bounded by lines in FIGS. 3 to 6 indicates higher color reproducibility. The results of FIGS. 3 to 6 revealed that Comparative Examples 1 to 12 were inferior to Examples 1 to 7 in terms of color reproducibility.

TABLE A

| | Japan Color | | Ex. 1 | | Ex. 2 | | Ex. 3 | | Ex. 4 | |
|---|---|---|---|---|---|---|---|---|---|---|
| | a* | b* | a* | b* | a* | b* | a* | b* | a* | b* |
| Yellow | −6.6 | 91.1 | −5.08 | 99.84 | −7.28 | 98.01 | −7.56 | 102.7 | −6.66 | 105.5 |
| Red | 68.5 | 48 | 69.5 | 48.5 | 69.1 | 48 | 69.8 | 50 | 70.3 | 50.5 |
| Magenta | 74.4 | −4.8 | 76.57 | −0.62 | 69.68 | −9.34 | 74.62 | −5.01 | 76.57 | −0.62 |
| Blue | 20 | −51 | 19.48 | −49.3 | 20.66 | −45.9 | 19.96 | −50.2 | 19.81 | −48.3 |
| Cyan | −37.5 | −50.4 | −30.3 | −42 | −27 | −36.5 | −30.2 | −39.5 | −30.3 | −42 |
| Green | −73.5 | 25 | −69.9 | 21.39 | −72.2 | 22.34 | −72.5 | 27 | −70.7 | 25 |
| Yellow | −6.6 | 91.1 | −5.08 | 99.84 | −7.28 | 98.01 | −7.56 | 102.7 | −6.66 | 105.5 |

| | Ex. 5 | | Ex. 6 | | Ex. 7 | |
|---|---|---|---|---|---|---|
| | a* | b* | a* | b* | a* | b* |
| Yellow | −7.6 | 99.43 | −7.56 | 105.7 | −7.62 | 99.5 |
| Red | 66.1 | 47.83 | 72.3 | 49.5 | 66.76 | 47.91 |
| Magenta | 68 | −2.96 | 76.2 | −5.01 | 68.88 | −9.26 |
| Blue | 22.55 | −46.6 | 19.96 | −50.2 | 21.55 | −47 |
| Cyan | −26.2 | −34.5 | −32.3 | −41.5 | −30 | −33.5 |
| Green | −67.9 | 23.1 | −75.8 | 27 | −68 | 23.02 |
| Yellow | −7.6 | 99.43 | −7.56 | 105.7 | −7.62 | 99.5 |

TABLE B

| | Comp. Ex. 1 | | Comp. Ex. 2 | | Comp. Ex. 3 | | Comp. Ex. 4 | | Comp. Ex. 5 | | Comp. Ex. 6 | |
|---|---|---|---|---|---|---|---|---|---|---|---|---|
| | a* | b* | a* | b* | a* | b* | a* | b* | a* | b* | a* | b* |
| Yellow | −7.6 | 96.43 | −7.67 | 94.74 | −9.31 | 94.52 | −8.23 | 92.13 | −7.4 | 97.33 | −7.45 | 97.65 |
| Red | 61.1 | 46.83 | 65.5 | 47.2 | 58.4 | 47 | 56.37 | 44.11 | 62.1 | 46.63 | 61.8 | 46.53 |
| Magenta | 60.8 | −9.96 | 66.68 | −8.34 | 57.57 | −12.22 | 57.57 | −12.22 | 60.8 | −10 | 60.3 | −9.86 |
| Blue | 21.55 | −36.6 | 20 | −34.2 | 19.8 | −31.5 | 20 | −27 | 21.03 | −36.6 | 21 | −37.6 |
| Cyan | −26.17 | −34.48 | −23.99 | −30.95 | −21.33 | −27.66 | −21.33 | −27.66 | −26.17 | −34.48 | −27.13 | −34.99 |
| Green | −66.88 | 23.1 | −65.2 | 23.9 | −64.5 | 25.3 | −60.5 | 23 | −67.22 | 23.3 | −68.02 | 23.25 |
| Yellow | −7.6 | 96.43 | −7.67 | 94.74 | −9.31 | 94.52 | −8.23 | 92.13 | −7.4 | 97.33 | −7.45 | 97.65 |

TABLE C

| | Comp. Ex. 7 | | Comp. Ex. 8 | | Comp. Ex. 9 | | Comp. Ex. 10 | | Comp. Ex. 11 | | Comp. Ex. 12 | |
|---|---|---|---|---|---|---|---|---|---|---|---|---|
| | a* | b* | a* | b* | a* | b* | a* | b* | a* | b* | a* | b* |
| Yellow | −7.68 | 96.66 | −7.65 | 96.56 | −8.01 | 91.98 | −7.88 | 93.23 | −8.3 | 92.52 | −7.62 | 91.45 |
| Red | 62.1 | 46.85 | 62.32 | 46.8 | 56.3 | 44.51 | 56.88 | 45.45 | 57.26 | 45.29 | 55.76 | 44.71 |
| Magenta | 61.18 | −9.9 | 61.33 | −10.1 | 57.61 | −11.9 | 58.81 | −11.6 | 57.56 | −11.4 | 57.83 | −12.5 |
| Blue | 21.72 | −37 | 21.6 | −38 | 20 | −27 | 22.05 | −28.3 | 21.89 | −28.6 | 19.67 | −27 |
| Cyan | −26.2 | −34.6 | −26.3 | −34.7 | −20.8 | −27.8 | −21.3 | −28.6 | −21 | −29 | −19.8 | −28.2 |
| Green | −67 | 23.07 | −67.1 | 23.02 | −61.5 | 23.27 | −62.4 | 23.78 | −62.8 | 23.31 | −60.7 | 23.37 |
| Yellow | −7.68 | 96.66 | −7.65 | 96.56 | −8.01 | 91.98 | −7.88 | 93.23 | −8.3 | 92.52 | −7.62 | 91.45 |

TABLE 1

| | Number-average particle diameter of pigment [μm] | Ratio of pigment particles having particle diameter ≥0.7 μm [% by number] | (Cr)/((Cr) + (Am)) | Master-batch resin No. | Urethane-urea group conc. α of master-batch resin [% by mass] | Ratio of crystalline portion in master-batch resin [% by mass] | Binder resin No. | Urethane-urea group conc. β of binder resin (% by mass) | Ratio of crystal-line portion in binder resin (% by mass) | Low-temp. fixing property | Storage stability | Color reproducibility |
|---|---|---|---|---|---|---|---|---|---|---|---|---|
| Ex. 1 | 0.37 | 4.0 | 0.21 | A1 | 5 | 75 | B1 | 2 | 80 | A | A | See |
| Ex. 2 | 0.48 | 4.3 | 0.24 | A2 | 2 | 80 | B1 | 2 | 80 | A | A | FIGS. 3-6 |
| Ex. 3 | 0.28 | 2.7 | 0.15 | A3 | 13 | 50 | B2 | 5 | 60 | B | A | |
| Ex. 4 | 0.31 | 3.1 | 0.18 | A4 | 11 | 60 | B2 | 5 | 60 | B | A | |
| Ex. 5 | 0.37 | 3.8 | 0.39 | A6 | 5 | 100 | B3 | 5 | 100 | A | A | |
| Ex. 6 | 0.23 | 2.4 | 0.37 | A7 | 25 | 100 | B4 | 25 | 100 | A | A | |
| Ex. 7 | 0.34 | 3.2 | 0.13 | A3 | 13 | 50 | B2 + E | 4 | 50 | A | B | |
| Comp. Ex. 1 | 0.53 | 6.0 | 0.26 | A5 | 1 | 85 | B1 | 2 | 80 | A | A | |
| Comp. Ex. 2 | 0.56 | 5.9 | 0.25 | — | — | — | B1 | 2 | 80 | A | A | |
| Comp. Ex. 3 | 0.31 | 5.0 | 0.00 | D | 8 | 0 | E | 6 | 0 | C | C | |
| Comp. Ex. 4 | 0.61 | 6.4 | 0.41 | A5 | 1 | 85 | B5 | 1 | 90 | A | C | |
| Comp. Ex. 5 | 0.46 | 4.8 | 0.12 | A8 | 0 | 100 | B6 | 0 | 100 | A | C | |
| Comp. Ex. 6 | 0.42 | 6.1 | 0.26 | A2 | 2 | 80 | B5 | 1 | 90 | A | C | |
| Comp. Ex. 7 | 0.52 | 4.3 | 0.21 | A1 | 5 | 75 | B5 | 1 | 90 | A | C | |
| Comp. Ex. 8 | 0.51 | 4.0 | 0.19 | A2 | 2 | 80 | B2 | 5 | 60 | B | A | |
| Comp. Ex. 9 | 0.61 | 6.3 | 0.22 | D | 8 | 0 | B1 | 2 | 80 | B | A | |
| Comp. Ex. 10 | 0.58 | 6.0 | 0.16 | D | 8 | 0 | B2 | 5 | 60 | C | A | |
| Comp. Ex. 11 | 0.55 | 5.9 | 0.27 | D | 8 | 0 | B3 | 5 | 100 | B | A | |
| Comp. Ex. 12 | 0.6 | 6.5 | 0.28 | D | 8 | 0 | B4 | 25 | 100 | B | A | |

Aspects of the present invention are as follows.

<1> A toner, including:

a crystalline binder resin including a urethane bond or a urea bond, or both thereof, and a colorant, wherein the colorant has a number-average particle diameter of 0.5 μm or less, and a ratio of particles having a particle diameter of 0.7 μm or greater in a number-size distribution of the colorant is 5% by number or less.

<2> The toner according to <1>, wherein, in a diffraction spectrum obtained by x-ray diffraction of the toner, a ratio [Cr/(Cr+Am)] is 0.15 or greater, where Cr is an integrated intensity of a spectrum derived from a crystalline structure of the crystalline binder resin, and Am is an integrated intensity of a spectrum derived from a non-crystalline structure of the crystalline binder resin.

<3> The toner according to any one of <1> to <2>, wherein the crystalline binder resin having a urethane bond or a urea bond, or both thereof includes two or more types of resins having different concentrations of urethane-urea groups.

<4> The toner according to any one of <1> to <3>, wherein the toner includes:

a masterbatch including the colorant and a crystalline binder resin for a masterbatch;

the crystalline binder resin; and a wax, wherein a concentration of urethane-urea groups α in the crystalline binder resin for a masterbatch and a concentration of urethane-urea groups β in the crystalline binder resin satisfy a formula: 0% by mass<β% by mass≤α% by mass.

<5> The toner according to <4>, wherein the crystalline binder resin for a masterbatch is any one of a resin composed only of a crystalline portion and a block resin composed of a crystalline portion and a non-crystalline portion.

<6> The toner according to <5>, wherein the crystalline portion or the non-crystalline portion, or both thereof is a resin selected from the group consisting of a polyester resin, a polyurethane resin, a polyurea resin, a polyether resin, and a composite resin thereof.

<7> The toner according to <4>, wherein the crystalline binder resin is any one of a resin composed only of a crystalline portion and a block resin composed of a crystalline portion and a non-crystalline portion.

<8> The toner according to <7>, wherein the crystalline portion or the non-crystalline portion, or both thereof is a resin selected from the group consisting of: a polyester resin, a polyurethane resin, a poly-urea resin, a polyether resin, and a composite resin thereof.

<9> The toner according to any one of <4> to <8>, wherein a content of the crystalline portion in the crystalline binder resin for a masterbatch is 50% by mass or greater, and a content of the crystalline portion in the crystalline binder resin is 50% by mass or greater.

<10> A two-component developer, including:

a toner according to any one of <1> to <9>, and a carrier.

<11> An image forming method, including:

forming an electrostatic latent image, wherein an electrostatic latent image is formed on an electrostatic latent image bearing member;

developing, wherein the electrostatic latent image is developed by a developer to form a visible image;

transferring, wherein the visible image is transferred to a recording medium; and fixing, wherein a transfer image transferred to the recording medium is fixed, wherein the developing is carried out using a developing unit including a developer bearing member which includes an internally fixed magnetic field generating unit and rotates while carrying the developer on a surface thereof, and wherein the developer is a two-component developer according to <10>.

<12> A process cartridge, including:

an electrostatic latent image bearing member, and a developing unit which forms a visible image by developing an electrostatic latent image formed on the electrostatic latent image bearing member with a developer, wherein the developer is a two-component developer according to <10>.

<13> An image forming apparatus, including:

an electrostatic latent image bearing member;

an electrostatic latent image forming unit configured to form an electrostatic latent image on the electrostatic latent image bearing member;

a developing unit configured to develop the electrostatic latent image by a developer to form a visible image;

a transfer unit configured to transfer the visible image to a recording medium; and a fixing unit configured to fix the visible image transferred to the recording medium, wherein the developing is carried out using a developing unit including a developer bearing member which includes an internally fixed magnetic field generating unit and rotates while carrying the developer on a surface thereof and wherein the developer is a two-component developer according to <10>.

<14> A toner accommodating container, including:

a toner according to any one of <1> to <9>; and a container which accommodates the toner therein.

This application claims priority to Japanese applications No. 2011-263686, filed on Dec. 1, 2011, and No. 2012-222561, filed on Oct. 4, 2012, and incorporated herein by reference.

What is claimed is:

1. A toner, comprising:

a crystalline binder resin comprising a urethane bond or a urea bond, or both thereof; and a colorant, wherein the colorant has a number-average particle diameter of 0.5 μm or less, and a ratio of particles having a particle diameter of 0.7 μm or greater in a number-size distribution of the colorant is 5% by number or less.

2. The toner according to claim 1, wherein, in a diffraction spectrum obtained by x-ray diffraction of the toner, a ratio [Cr/(Cr+Am)] is 0.15 or greater, where Cr is an integrated intensity of a spectrum derived from a crystalline structure of the crystalline binder resin, and Am is an integrated intensity of a spectrum derived from a non-crystalline structure of the crystalline binder resin.

3. The toner according to claim 1, wherein the crystalline binder resin having a urethane bond or a urea bond, or both thereof comprises two or more types of resins having different concentrations of urethane-urea groups.

4. The toner according to claim 1, wherein the toner comprises:

a masterbatch comprising the colorant and a crystalline binder resin for a masterbatch;

the crystalline binder resin; and a wax, wherein a concentration of urethane-urea groups $\alpha$ in the crystalline binder resin for a masterbatch and a concentration of urethane-urea groups $\beta$ in the crystalline binder resin satisfy a formula: 0% by mass$<\beta$% by mass$\leq\alpha$% by mass.

5. The toner according to claim 4, wherein the crystalline binder resin for a masterbatch is any one of a resin composed only of a crystalline portion and a block resin composed of a crystalline portion and a non-crystalline portion.

6. The toner according to claim 5, wherein the crystalline portion or the non-crystalline portion, or both thereof is a resin selected from the group consisting of: a polyester resin, a polyurethane resin, a polyurea resin, a polyether resin, and a composite resin thereof.

7. The toner according to claim 4, wherein the crystalline binder resin is any one of a resin composed only of a crystalline portion and a block resin composed of a crystalline portion and a non-crystalline portion.

8. The toner according to claim 7, wherein the crystalline portion or the non-crystalline portion, or both thereof is a resin selected from the group consisting of: a polyester resin, a polyurethane resin, a polyurea resin, a polyether resin, and a composite resin thereof.

9. The toner according to claim 4, wherein a content of the crystalline portion in the crystalline binder resin for a masterbatch is 50% by mass or greater, and a content of the crystalline portion in the crystalline binder resin is 50% by mass or greater.

10. A two-component developer, comprising:

a toner; and a carrier, wherein the toner comprises:

a crystalline binder resin comprising a urethane bond or a urea bond, or both thereof; and a colorant, wherein the colorant has a number-average particle diameter of 0.5 μm or less, and a ratio of particles having a particle diameter of 0.7 μm or greater in a number-size distribution is 5% by number or less.

11. An image forming method, comprising:

forming an electrostatic latent image, wherein an electrostatic latent image is formed on an electrostatic latent image bearing member;

developing, wherein the electrostatic latent image is developed by a developer to form a visible image;

transferring, wherein the visible image is transferred to a recording medium; and fixing, wherein a transfer image transferred to the recording medium is fixed, wherein the developing is carried out using a developing unit comprising a developer bearing member which comprises an internally fixed magnetic field generating unit and rotates while carrying the developer on a surface thereof, wherein the developer is a two-component developer, comprising:

a toner; and a carrier, wherein the toner comprises:

a crystalline binder resin comprising a urethane bond or a urea bond, or both thereof; and a colorant, and wherein the colorant has a number-average particle diameter of 0.5 μm or less, and a ratio of particles having a particle diameter of 0.7 μm or greater in a number-size distribution is 5% by number or less.

* * * * *